US011035089B1

(12) United States Patent
Calloway et al.

(10) Patent No.: US 11,035,089 B1
(45) Date of Patent: Jun. 15, 2021

(54) SYSTEM AND METHOD FOR EFFICIENT ENGINE OPERATION

(71) Applicant: Old Dominion Brush Company, Henrico, VA (US)

(72) Inventors: Britt R. Calloway, Midlothian, VA (US); Kevin M. Davis, Aylett, VA (US); Robert Mayes, Hanover, VA (US); Tim Stumph, Midlothian, VA (US); Chris Turner, Aylett, VA (US)

(73) Assignee: Old Dominion Brush Company, Henrico, VA (US)

( * ) Notice: Subject to any disclaimer, the term of this patent is extended or adjusted under 35 U.S.C. 154(b) by 0 days.

(21) Appl. No.: 16/990,759

(22) Filed: Aug. 11, 2020

(51) Int. Cl.
*E01H 1/08* (2006.01)
*A47L 9/28* (2006.01)

(52) U.S. Cl.
CPC ..... *E01H 1/0836* (2013.01); *A47L 9/2857* (2013.01); *E01H 2001/0881* (2013.01)

(58) Field of Classification Search
CPC ..... E01H 1/0836; E01H 2001/0881; A47L 9/2857
USPC ..... 15/319, 339, 340.1
See application file for complete search history.

(56) References Cited

U.S. PATENT DOCUMENTS 4,958,406 A * 9/1990 Toyoshima ..... A47L 9/2842 15/319
2002/0157212 A1* 10/2002 Velinsky ..... E01H 1/0827 15/414
2010/0252075 A1* 10/2010 Crockett ..... E01H 1/0836 134/21
2013/0269150 A1* 10/2013 Hartley ..... F16L 3/217 15/347

* cited by examiner

*Primary Examiner* — David Redding
(74) *Attorney, Agent, or Firm* — Sterne, Kessler, Goldstein & Fox P.L.L.C.

(57) ABSTRACT

A system and method for efficient engine operation of a material collection system is provided. A material collection system can have a control system, a boom that supports a conduit, a power source, and a vacuum generator. Sensors can provide data on operation of the material collection system. The control system can adjust the vacuum generator power output based on sensor data to efficiently manage energy usage.

20 Claims, 16 Drawing Sheets

SYSTEM AND METHOD FOR EFFICIENT ENGINE OPERATION

FIELD

The present disclosure generally relates to systems and methods for efficient engine operation. In particular, embodiments relate to efficient operation of material collection equipment.

BACKGROUND

Material collection equipment can be used to intake a variety of debris for removal and disposal. Some material collection equipment can include additional functionality such as cleaning, sweeping, and excavation. Some equipment can be mounted onto a vehicle or a trailer pulled by a vehicle, other equipment can be mounted onto other mobile equipment such as tracked or rail-bound vehicles. Material collection equipment can utilize a number of mechanisms for intaking debris. For example, some material collection equipment can use a vacuum generator to intake debris. An operator can manually control the power of the vacuum generator (e.g., manually change the speed of the vacuum generator).

BRIEF SUMMARY

One aspect of the invention can provide a material collection system that includes a conduit, a vacuum generator, a boom, a sensor, and a control system. The conduit can include a material inlet. The vacuum generator can develop an airflow and draw material into the material inlet. The boom can support the conduit. The sensor can indicate a condition of the material collection system and providing a sensor output signal. The control system can control a speed of the vacuum generator to a first speed setting and a second speed setting based on the sensor output signal. In some aspects, the sensor output signal can correspond to material in the conduit. In some aspects, the material collection system can further include a second sensor. The second sensor can indicate a second condition of the material collection system and can provide a second output signal. The second sensor output signal can correspond to the boom being in a stored position. The control system can control the speed of the vacuum generator based on the second output signal. In some aspects, the first speed can be an idle speed and the second speed can be a work speed such that the work speed is greater than the idle speed. In some aspects, the first speed can be approximately 1,200 RPM. In some aspects, the second speed can be approximately 2,400 RPM. In some aspects, the second speed can be approximately 2,400 RPM. In some aspects, the first speed can be zero and the second speed can be greater than approximately 1,200 RPM. In some aspects, the sensor can be positioned at the intake end. In some aspects the sensor can be positioned adjacent to the vacuum generator. In some aspects, the vacuum generator can be powered by an internal combustion engine such that the control system controls the speed of the internal combustion engine.

In a further aspect of this invention, a material collection system can include a vacuum generator, a conduit, a boom, a material collection container, a sensor, and a control system. The conduit can include a material inlet. The boom can support the conduit, the boom being movable from a stowed position to an operating position. The material collection container can receive collected material from the conduit. The sensor can indicate whether the boom is in the stowed position and can provide a sensor output signal. The control system can control a speed of the vacuum generator to a first speed setting and a second speed setting based on the sensor output signal. In some aspects, the material collection system can further include a second sensor to indicate a presence of material in the conduit and can provide a second output signal. The control system can control the speed of the vacuum generator based on the second output signal. In some aspects, the material collection system can include a second sensor to indicate a full condition of the material collection container, the second sensor providing a second output signal. The control system can control the speed of the vacuum generator based on the second output signal. In some aspects, the second speed can be approximately 1,200 RPM when the second sensor indicates the full condition.

In another aspect, a method for operating a material collection system can include operating a vacuum generator at a first speed, the vacuum generator developing an airflow to draw material into a material inlet of a conduit. The method can also include receiving an electronic signal from a sensor indicating a condition of the material collection system. The method can include, based on the electronic signal, increasing the speed of the vacuum generator to a second speed. In some aspects, the first speed can be less than approximately 2,400 RPM. In some aspects, the second speed can be greater than approximately 1,200 RPM. In some aspects, the electronic signal can indicate that a boom on the material collection system is positioned in a storage position. In some aspects, the electronic signal can indicate that material is present in the conduit. In some aspects, the method can further include receiving a user input to change the second speed.

BRIEF DESCRIPTION OF THE FIGURES

The accompanying drawings, which are incorporated herein and form part of the specification, illustrate embodiments and, together with the description, further serve to explain the principles of the embodiments and to enable a person skilled in the relevant art(s) to make and use the embodiments.

Figure 1:
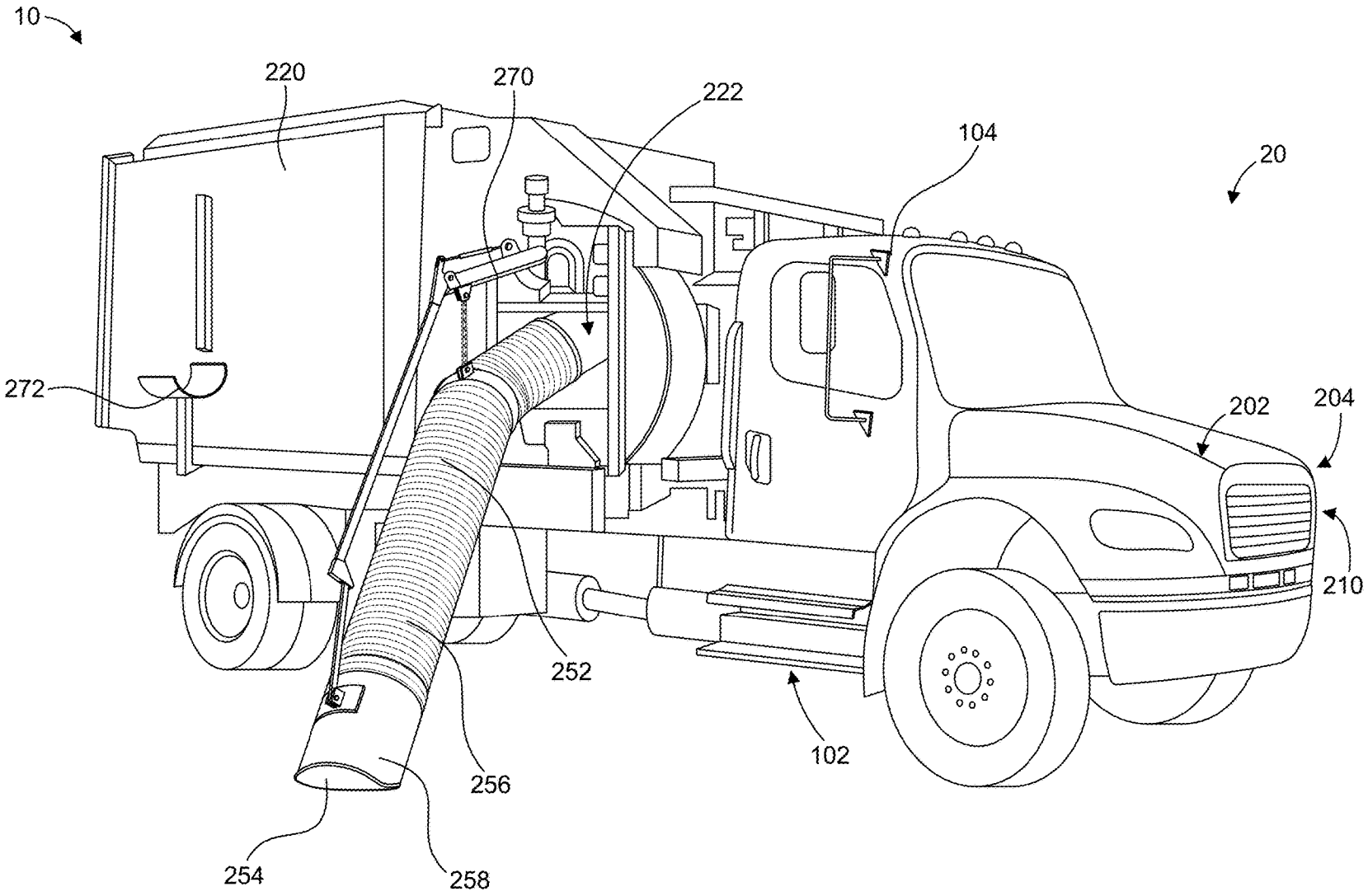
FIG. 1 is a perspective view of a vehicle with material collection equipment according to various aspects of the invention.

The features and advantages of the embodiments will become more apparent from the detail description set forth below when taken in conjunction with the drawings, in which like reference characters identify corresponding elements throughout. In the drawings like reference numbers generally indicate identical, functionally similar, and/or structurally similar elements.

DETAILED DESCRIPTION

Embodiments of the present disclosure are described in detail with reference to embodiments thereof as illustrated in the accompanying drawings. References to "one embodiment," "an embodiment," "an exemplary embodiment," etc., indicate that the embodiment described can include a particular feature, structure, or characteristic, but every embodiment can not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following examples are illustrative, but not limiting, of the present embodiments. Other suitable modifications and adaptations of the variety of conditions and parameters normally encountered in the field, and which would be apparent to those skilled in the art, are within the spirit and scope of the disclosure.

Material collection systems can be used to intake a variety of materials, such as debris. Material collection equipment can include a conduit, e.g., a hose, supported by a boom. The boom can be connected to a vehicle on one end. The conduit can be used to direct airflow generated by a vacuum generator and have an intake end to engage with a pickup site for material collection, such as via a nozzle. A material collection system can also include a boom control system. In this example, an operator can move the boom, and therefore the conduit, around the longitudinal, lateral, and/or vertical axes using the control system.

Material collection equipment can be driven using a variety of power sources. For example, a material collection system can mount onto a vehicle having an engine, such as a truck. The engine can propel the vehicle forward and drive the boom, vacuum generator, and/or other material collection equipment. The vacuum generator, powered by the engine, can run at various speeds and can be specified by an operator. Material collection equipment can alternatively be mounted onto other mobile equipment such as tracked or rail-bound vehicles or a trailer pulled by a vehicle.

Frequently, the vacuum generator driven by the vehicle engine operates at a work speed, e.g., a higher operating speed, for as long as the vehicle is running. The vehicle can run for several hours or entire days, including when not operating to collect material, such as while traveling or idling when not at the pickup site. Accordingly, the vacuum generator can remain at the work speed for large amounts of time outside of a material collection operation.

Maintaining the vacuum generator speed at the work speed when not collecting material can be an inefficient use of power. Consumption of fuel/energy can lead to a need to refuel or charge and to service the engine, which can require expending additional time and monetary resources. Efficient vehicle power consumption can be beneficial, especially in trucks that consume a large amount of fuel/energy. As discussed herein, it can be beneficial operating the vacuum generator at a higher speed, e.g., a work speed, when collecting material, but operating the vacuum generator at a lower speed, e.g., an idle speed, when not collecting material.

Aspects of the present disclosure provide a material collection system that can include control systems and methods for efficient operation. Instead of running the vacuum generator at the work speed outside of a material collection operation, operating the vacuum generator at lower speeds during these intervals can provide greater efficiency. The system can determine when a material collection operation is not needed by detecting when the boom is in a storage position, e.g., in a rack on the vehicle, or when material is not present for collection. The material collection system can include one or more sensors that provide information related to the boom position and presence of material to be collected. For example, a boom-in-rack sensor can indicate when the boom is in a stored position. A debris detection sensor can indicate when material is detected. A control system can provide control of the power source and/or material collection equipment according to the sensor data. Control of the power source and/or equipment such as the boom and vacuum generator can provide greater operating efficiency. The control system can include stored programs (e.g., control logic) to instruct the processor on power source and/or equipment control. For example, the control system can adjust the engine speed based on programmed instructions and/or user input. The control system can further include a control device to operate the control system.

Aspects will now be described in more detail with reference to the figures. With reference to FIG. 1, in some aspects, a material collection system 10 can be mounted onto a vehicle 20, which can be, for example, a truck. Vehicle 20 can include vehicle 20 components, such as a chassis 102 and/or a cab 104. Material collection system 10 can include several material collection system components, such as a power source 202, a container 220, a vacuum generator 232, a conduit 252, and/or a boom 270.

In some aspects, material collection system 10 and cab 104 can be mounted on a chassis 102. An operator can reside in cab 104 and drive vehicle 20 to a material pickup site. In some aspects, the operator can reside in cab 104 during a material collection operation. In another aspect, the operator and/or a second operator can manually control material collection system 10 components. For example, the operator can reside in cab 104 and a second operator can be external to the cab. The second operator can manually move conduit 252 and can manually position conduit 252 for material collection.

In some aspects, power source 202 can provide motive power to vehicle 20. For example, power source 202 can include a chassis engine 204 (i.e., a primary engine powering vehicle 20) that moves vehicle 20. In some aspects, chassis engine 204 can be an internal combustion engine. In another aspect, chassis engine 204 can be an electric motor powered by a battery hybrid or battery system. In an aspect, power source 202 can power material collection system 10 mounted onto vehicle 20. For example, power source 202 can power material collection system equipment, such as vacuum generator 232.

Figure 2:
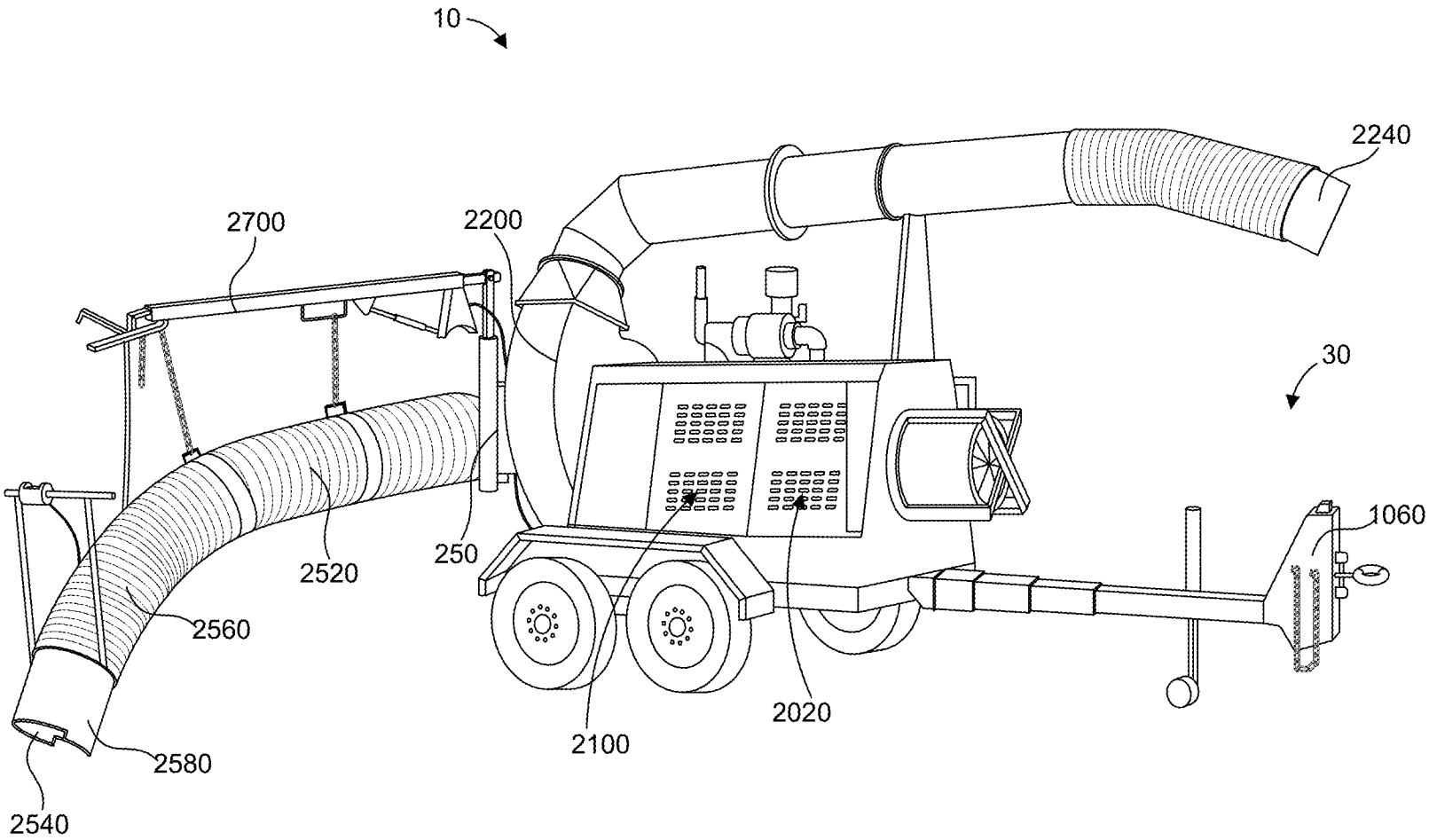
FIG. 2 is a perspective view of a trailer with material collection equipment according to various aspects of the invention.

With reference to FIG. 2, in some aspects, a material collection system 10 can be mounted onto a trailer 30 (e.g., a dual-axle trailer), and can include chassis 1020 and/or a towbar 1060. Material collection system 10 can further include material collection system equipment, such as power source 2020, vacuum generator 2320, conduit 2520, and/or boom 2700.

In some aspects, material collection system 10 can be mounted on chassis 1020. In some aspects, towbar 1060 can connect chassis 1020 to a towing vehicle (not shown). The towing vehicle can provide motive power to move material collection system 10. In some aspects, power source 202 can include an auxiliary engine 2100 that can power vacuum generator 2320 or other components of material collection system 10. In an aspect, auxiliary engine 2100 can be an electrical motor powered by a battery hybrid or battery system.

Throughout the disclosure, components can be referred to with reference to a material collection system 10 that can be mounted on a vehicle 20, but it will be appreciated that the disclosed systems and methods can be applicable to other aspects as well (e.g., mounted to a trailer, or tracked or rail-bound vehicles), and can include additional functionalities (e.g., sweeping, sewer cleaning, contamination removal, excavation, and/or landscaping, stump and mulch removal, litter collection, rail ballast collection, residential and industrial "shop vac")

Figure 3:
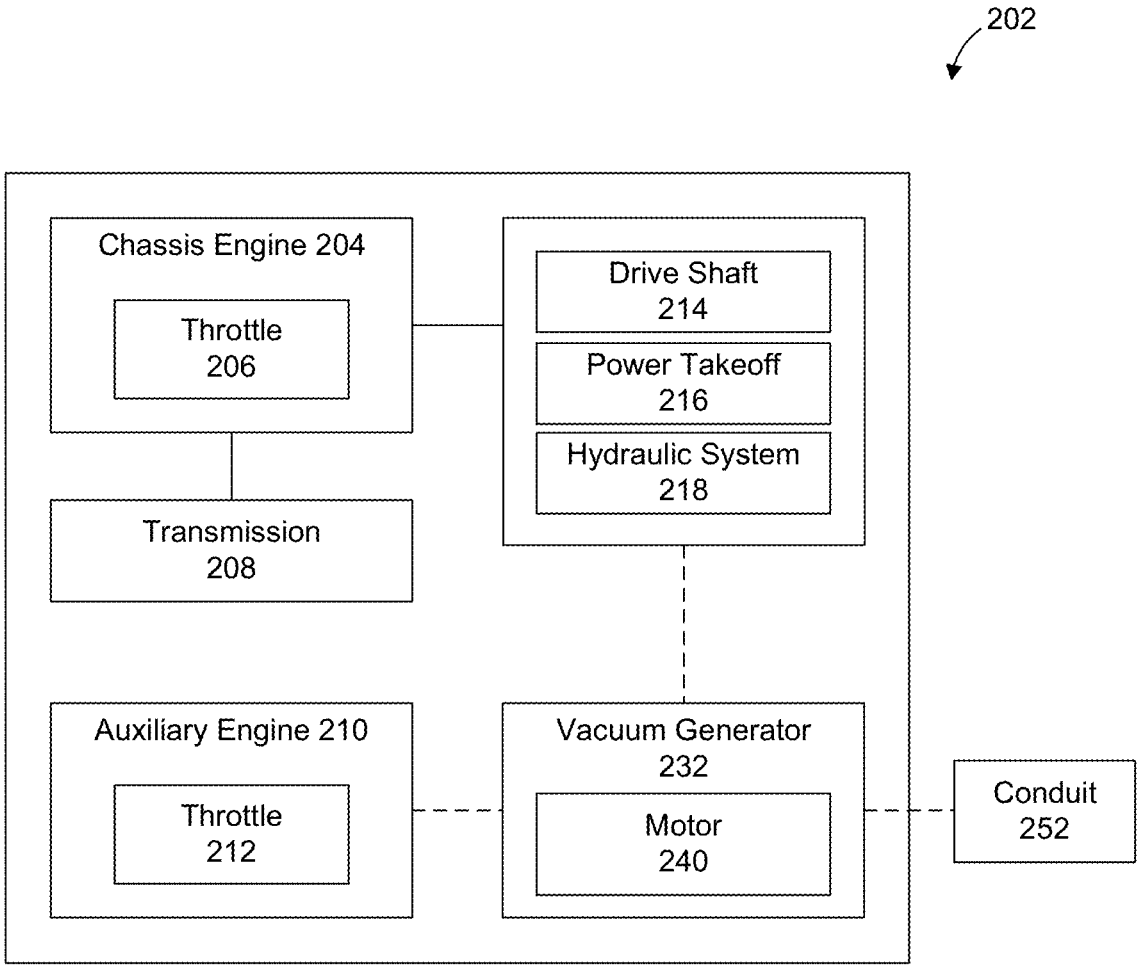
FIG. 3 is a vehicle component schematic according to various aspects of the invention.

With reference to FIG. 3, in some aspects, power source 202 can include chassis engine 204, a throttle 206, a transmission 208, an auxiliary engine 210, a throttle 212, a drive shaft 214, power takeoff(s) 216, and/or a hydraulic system 218. In some aspects, power source 202 can power material collection equipment, such as vacuum generator 232. In some aspects, while at a high speed (e.g., above 1,200 RPM), vacuum generator 232 can have sustained kinetic energy. Accordingly, power source 202 can disengage from vacuum generator 232 at high speeds.

In some aspects, throttle 206 can control the power output of chassis engine 204. In an aspect, chassis engine 204 can provide power to drive vacuum generator 232 and/or other material collection system 10 equipment. Chassis engine 204 can, for example, power vacuum generator 232 using drive shaft 214, power takeoff(s) 216, hydraulic system 218, or indirectly via a drive belt system (not shown).

In some aspects, vehicle 20 can include auxiliary engine 210. In some aspects, throttle 212 can control the power output of auxiliary engine 210. In an aspect, auxiliary engine 210 can be the primary engine for vehicle 20. For example, when vehicle 20 is idle, using auxiliary engine 210 to power vehicle 20 instead of chassis engine 232 can reduce overall power consumption.

In some aspects, vacuum generator 232 can include a motor 240. In an aspect, motor 240 can drive vacuum generator 232. Motor 240 can be an electrical motor powered by a battery hybrid or battery system.

Figure 4:
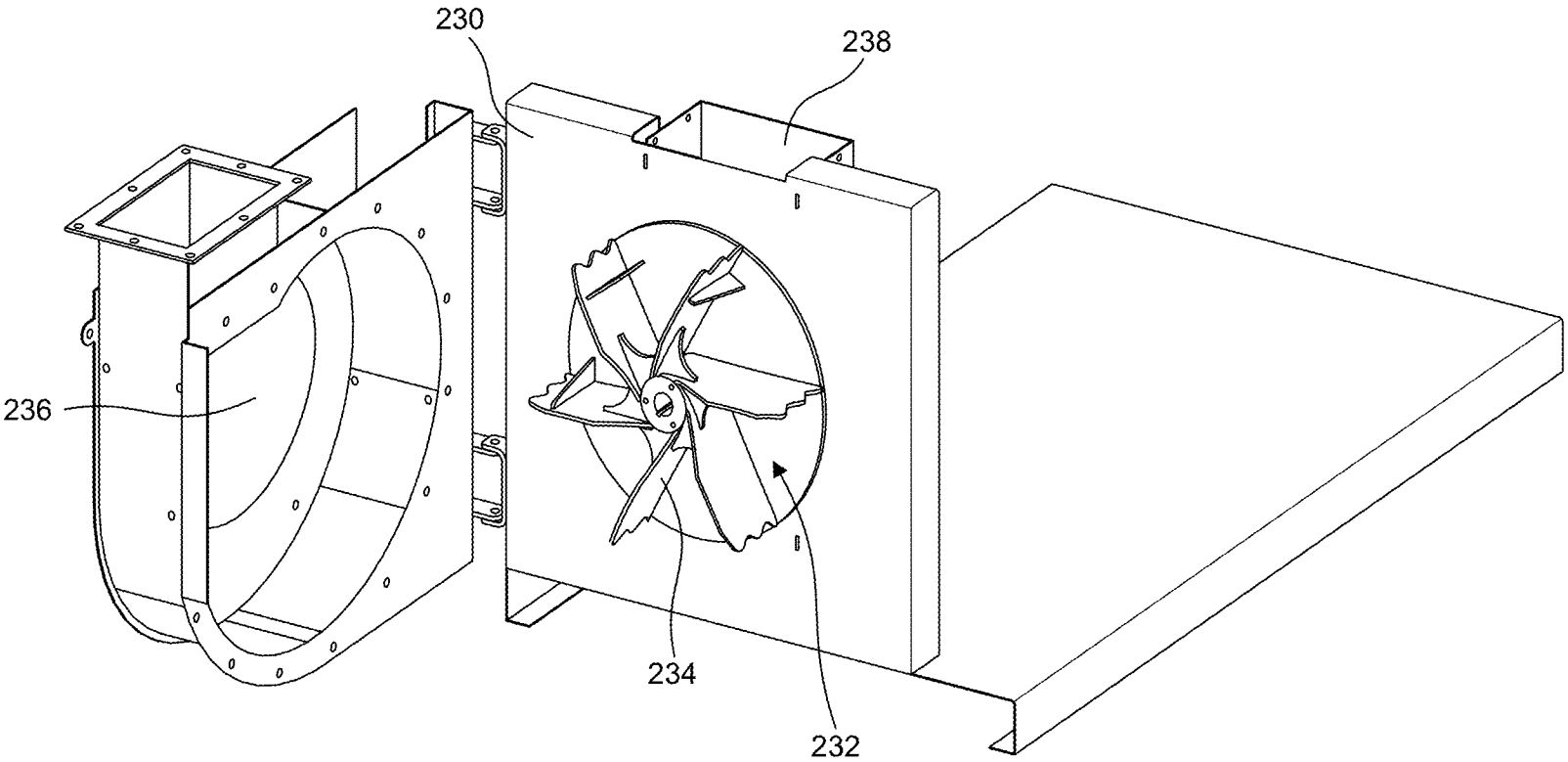
FIG. 4 is a perspective view of a vacuum generator according to various aspects of the invention.

With reference to FIG. 4, in some aspects, vacuum generator 232 can be, for example, a fan (i.e., a material handling fan). A fan can include a plurality of blades 234 that can rotate when powered to develop a sub-atmospheric pressure airflow. In an aspect, blades 234 can also chop incoming material into small pieces as the material passes the blades. In some aspects, vacuum generator 232 can be included in a housing 230. Housing 230 can have an outlet that can connect to container 220 (i.e., a collection hopper). In some aspects, housing 230 can have an inlet 236 that can connect to vacuum generator 232. In some aspects, vacuum generator 232 does not directly convey material through a fan, but can generate a negative pressure to draw in material for discharge into container 220. In some aspects, vacuum generator 232 can be a Venturi vacuum generator that can produce a stream of compressed air to create a vacuum and intake material.

In some aspects, the load on power source 202, such as chassis engine 204, auxiliary engine 210, and/or motor 240 can be monitored with engine control unit (ECU) information. In some aspects, the load on electrical motors can be monitored with controller information. Load information can include the amount of material conveyed through, for example, a fan vacuum generator 232.

Figure 5:
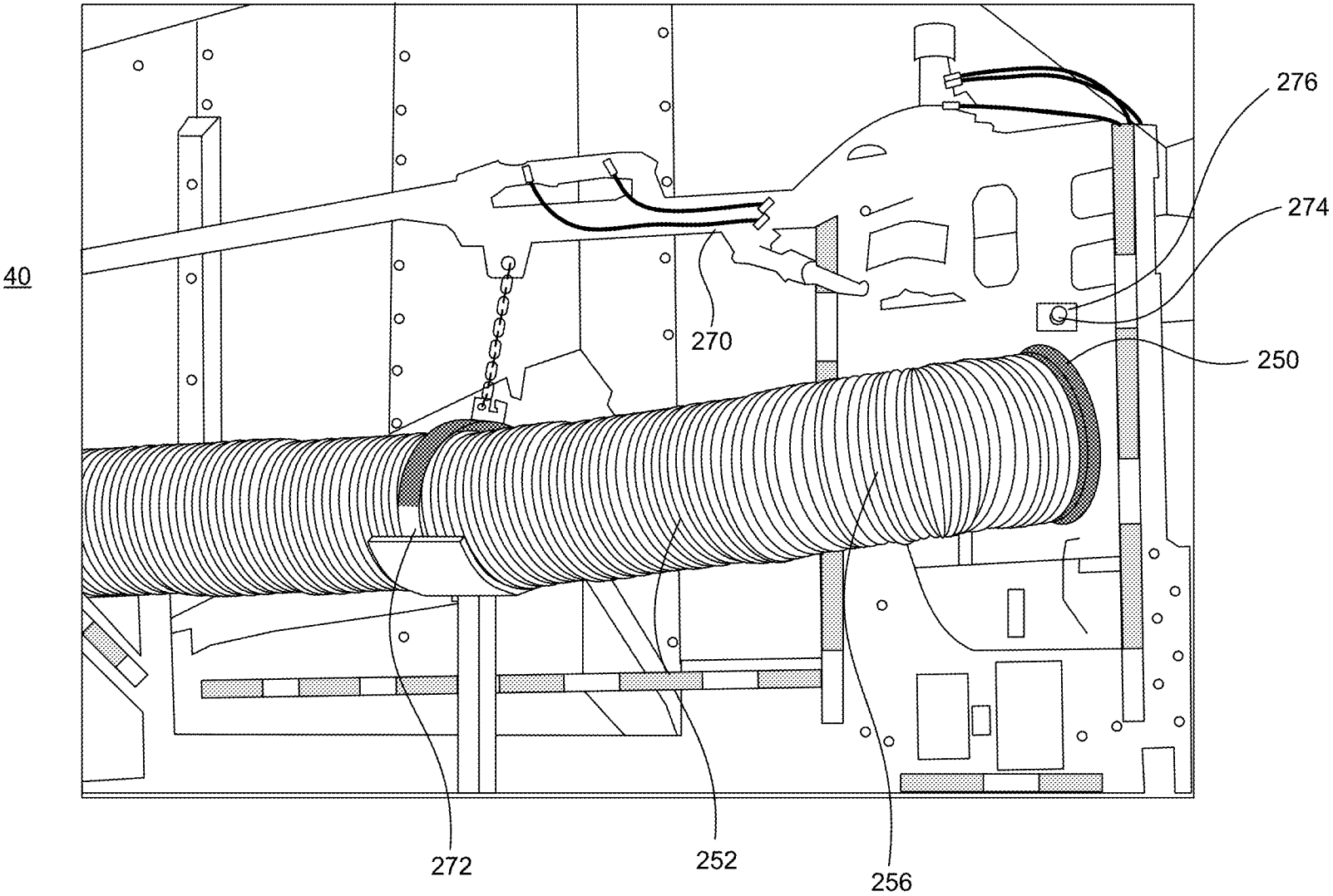
FIG. 5 is a perspective view of material collection equipment according to various aspects of the invention.
Figure 6:
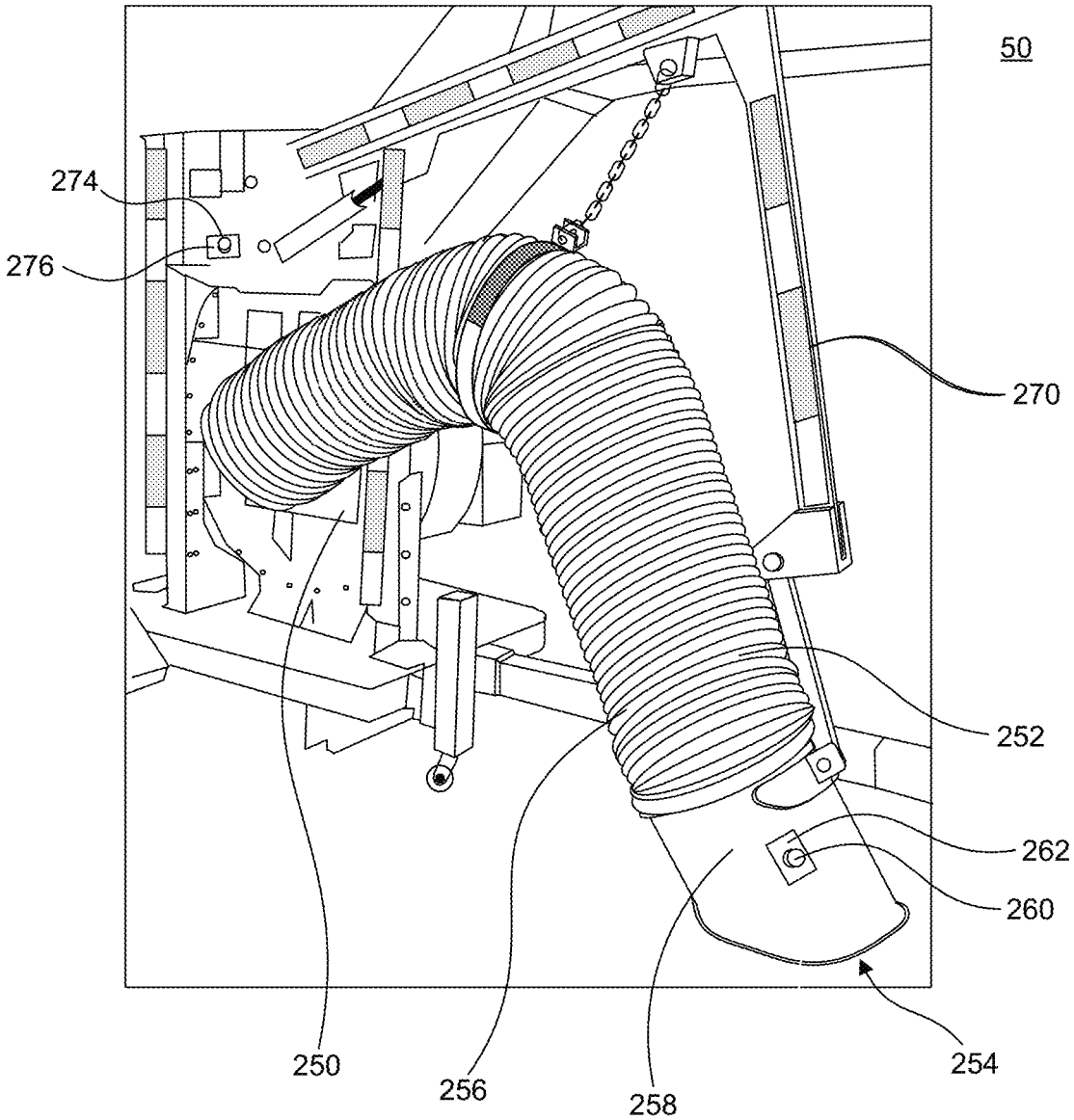
FIG. 6 is a perspective view of material collection equipment according to various aspects of the invention.

With reference to FIG. 5, in some aspects, vacuum generator 232 can connect to conduit 252 such that airflow developed by vacuum generator 232 can be directed through conduit 252. With reference to FIGS. 5-6, in some aspects, conduit 252 can include an interior wall 254, an exterior wall 256, and/or intake end 248. In some aspects, interior wall 254 can be configured to support the airflow through conduit 252. For example, interior wall 254 can be smooth and free of obstructions. In some aspects, one or more sections of interior wall 254 and/or exterior wall 256 can include corrugated plastic. In some aspects, interior wall 254 and/or exterior wall 256 can include plastics, metals, composites, or a combination thereof. In some aspects, intake end 248 can include a nozzle that can engage with the pickup site. The nozzle can be, for example, round or rectangular and can be used to control the airflow through conduit 252.

In some aspects, an energy saving mode 326 can provide a fuel/energy-saving method of operation. In an aspect, fuel/energy saving mode 326 automatically reduces engine speed when high power is not needed. The vacuum generator 232 is similarly reduced as it can operate at approximately the same speed as the engine. In this disclosure, "approximately" can mean a range of 100 RPM (revolutions per minute) above or below the stated speed. In some aspects, the speed can range from 600 RPM to 6,000 RPM. In an aspect, the speed range can be increased such as by modifying the gear ratio in a planetary gearbox, belt pulley ratio, hydraulic motor displacement, generator voltage, motor voltages, and/or operating frequencies.

In some aspects, engine speed can be reduced to approximately 1,200 RPM while boom 270 is positioned in storage position 40 or when boom 270 is positioned in deployed position 50, but material is not sensed for ten seconds. In some aspects, reducing the speed of power source 202 during these intervals can reduce overall fuel/energy consumption (e.g., up to three gallons per hour less or a comparable decrease in electrical power consumption). In some aspects, material collection system 10 and/or vehicle 20 can use renewable energy sources, such as solar energy, which can also be monitored and/or controlled in a fuel/energy saving mode. In some aspects, reducing fuel/energy consumption can reduce operating costs (e.g., up to $3,000 per leaf season) as well as noise (e.g., up to 50%) and particulate matter collection (e.g., up to 50%). In some aspects, the fuel/energy saving mode can reduce particulate matter production as the airflow is periodically reduced, decreasing the air that enters container 220 and its exhaust. Running a power source at a lower speed including for prolonged periods can also reduce wear and tear on components. For example, running an engine at a lower speed can lower engine revolutions, reducing wear and tear on engine moving components. This can reduce the need for servicing and produce additional cost savings. With energy saving mode 326 active, the system can run certain operations if predetermined field conditions are detected. While aspects of the invention(s) will refer to certain system conditions, it will be appreciated that energy saving mode 326 can run in additional circumstances.

In some aspects, idling in vehicles can limit fuel/energy efficiency and can be complicated in material collection operations, which can require frequent and sometimes prolonged idling. In a dual-engine vehicle-mounted system, an auxiliary engine of the vehicle can function as the main source of power for the vehicle when it is idle. This operation method can reduce fuel/energy usage and power consumption. In the aggregate, the cost and power savings can be substantial. This operation can also reduce the frequency of servicing needed for a main engine as the main engine can run at a lower speed, lowering engine revolutions. Accordingly, aspects can include both chassis engine 204 and auxiliary engine 210 for decreasing idling and consequently, decreasing operating costs. Aspects implementing the disclosed control systems and methods can increase these savings.

Figure 7:
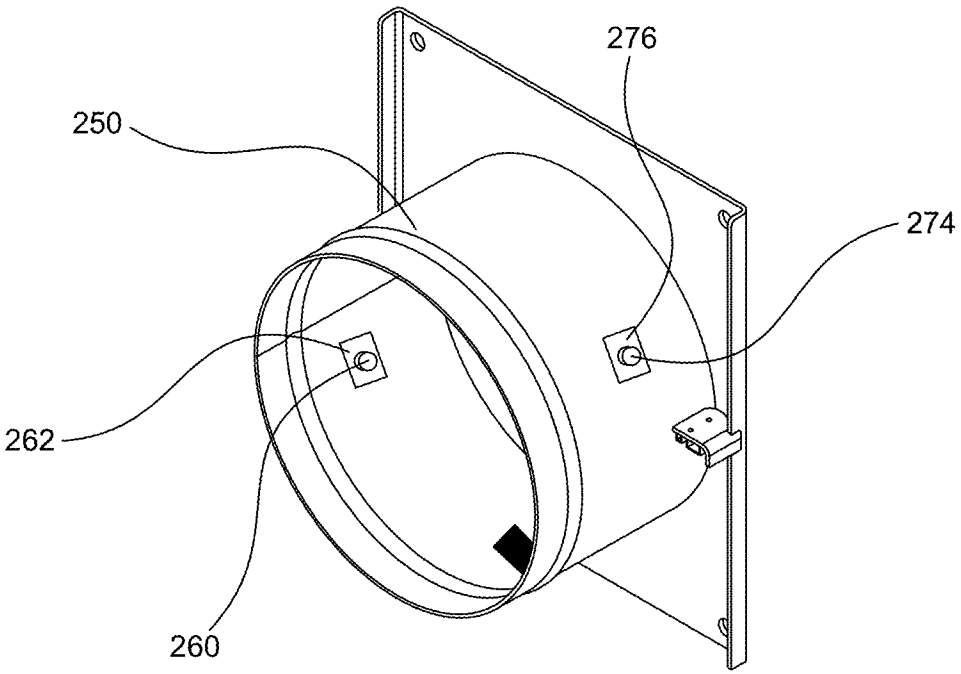
FIG. 7 is a perspective view of a hose eye according to various aspects of the invention.

With reference to FIGS. 5-7, in some aspects, material collection system 10 components can include one or more sensors to provide electronic signals indicative of system conditions (e.g., whether boom 270 is positioned in rack 272, whether material is present in conduit 252, water level in a water tank, material level in container 220, or airflow). The one or more sensors can include digital and/or analog sensors. In some aspects, the one or more sensors can output amplified and/or unamplified signals. In some aspects, the one or more sensors can be self-contained in its own housing (i.e., they include the sensor and a power source in a housing). In some aspects, the one or more sensors can be modular such that a sensor can be removably attached to a component of material collection system 10, or integrated into a component of material collection system 10. In other aspects, the one or more sensors can be a remote sensor 280 such that power can be provided by a remote power source 282. In some aspects, the sensors can also use a variety of renewable power sources (e.g., solar power, ambient RF, thermoelectric, etc.) Remote sensing can be advantageous as it can limit the size of the sensors, expanding the installation range.

In some aspects, the one or more sensors in material collection system 10 can be photoelectric sensors. Photoelectric sensors can include a receiver and an emitter (e.g., an LED). The receiver can detect the absence or presence of an object by receiving and processing light (i.e., any light that exists on the electromagnetic spectrum). The receiver can include an optical diode to receive light and configure an output. In some aspects, the photoelectric sensor is a reflective sensor that can be limited to a light spectrum (e.g., visible or infrared). For example, an infrared reflective sensor can detect objects that reflect light within the infrared spectrum. In this embodiment, photoelectric sensors are located within a body to avoid interference from the sun. In some aspects, the photoelectric sensor is a light beam sensor that can emit light (i.e., any light that exists on the electromagnetic spectrum) and detect interference in the light reaching the receiver.

In some aspects, the one or more sensors in material collection system 10 can be, for example, pressure, oxygen, temperature, kinetic, location, non-photoelectric proximity, capacitive, conductive, vibration, acceleration sensors, or a combination thereof, and/or can process light, radio waves, sound waves, or a combination thereof. For example, pressure sensors can provide a pressure differential from intake end 248 and outlet 238, and the pressure differential can indicate the presence and/or absence of material. In some aspects, the sensors disclosed and/or additional sensors can be vision sensors that include camera(s), for example, time-of-flight camera(s), RGB-D camera(s), stereo camera(s), and/or color camera(s). Sensor output data can include, for example, image, depth, and/or color data, or a combination thereof. For example, a material source (e.g., a leaf pile), can be detected using the depth data (e.g., one-dimensional, two-dimensional, or three-dimensional depth data). Material collection system 10 can additionally include load cells throughout the system (e.g., in conduit 252, vacuum generator 232, and/or container 220). In an aspect, the one or more sensors in material collection system 10 can include Global Positioning System (GPS) receivers. In some aspects, deflectors (not shown) can be used to deflect and/or direct material in the airflow away from the sensors. Deflectors can be included on or near associated sensor mounts.

In some aspects, boom 270 can be configured to lift and support conduit 252. In some aspects, boom 270 can be in rack 272 such that boom 270 can be in a storage position 40. In some aspects, boom 270 in rack 272 can indicate that a material collection operation is not active. In the storage position 40, boom 270 can be substantially parallel to chassis 102. In some aspects, conduit 252 can extend outward from vehicle 20 such that boom 270 can be in a deployed position 50. In some aspects, the amount of conduit 252 that extends from vehicle 20 can be adjustable such that conduit 252 can extend from vehicle 20 more or less, depending on the position of vehicle 20 and/or the pickup site. In some aspects, the extension of conduit 252 can be adjusted before or during a material collection operation.

In some aspects, boom 270 can be moved from a lower position (e.g., a position substantially parallel to chassis 102), as shown in FIG. 5, to a higher position (e.g., a position at an angle relative to chassis 102), as shown in FIG. 6. In an aspect, the lower position can be storage position 40 and the higher position can be deployed position 50. In other aspects, boom 270 can control movement of conduit 252 around the longitudinal, lateral, and/or vertical axes. In some aspects, the combination of moveable boom 270 and elastic conduit 252 can provide flexible positioning of intake end 248 at pickup sites.

In some aspects, the one or more sensors can include a boom-in-rack sensor 274. Boom-in-rack sensor 274 can indicate whether boom 270 is positioned in rack 272. Rack 272 can support boom 270 in a storage position. In some aspects, rack 272 can support boom-in-rack sensor 274. Boom-in-rack sensor 274 can alternatively be mounted onto hose eye 250 (FIG. 7). Boom 270 and/or rack 272 can include a sensor mount 276. In some aspects, sensor mount 276 can include a bracket that rotates about a point (e.g., swivels and/or tilts). In some aspects, sensor mount 276 can provide additional adjustability of the position of boom-in-rack sensor 274, for example, vertical and/or horizontal adjustment. Additionally, in some aspects, sensor mount 276 can include a flexible arm that can support boom-in-rack sensor 274 and be shaped into a support position. Sensor mount 276 can further include an enclosure to protect boom-in-rack sensor 274. Positioning flexibility can increase the installation range and therefore sensing zone of boom-in-rack sensor 274. For example, in a photoelectric sensor, an emitter and a receiver can be mounted on hose eye 250 and rack 272, respectively.

Figure 13:
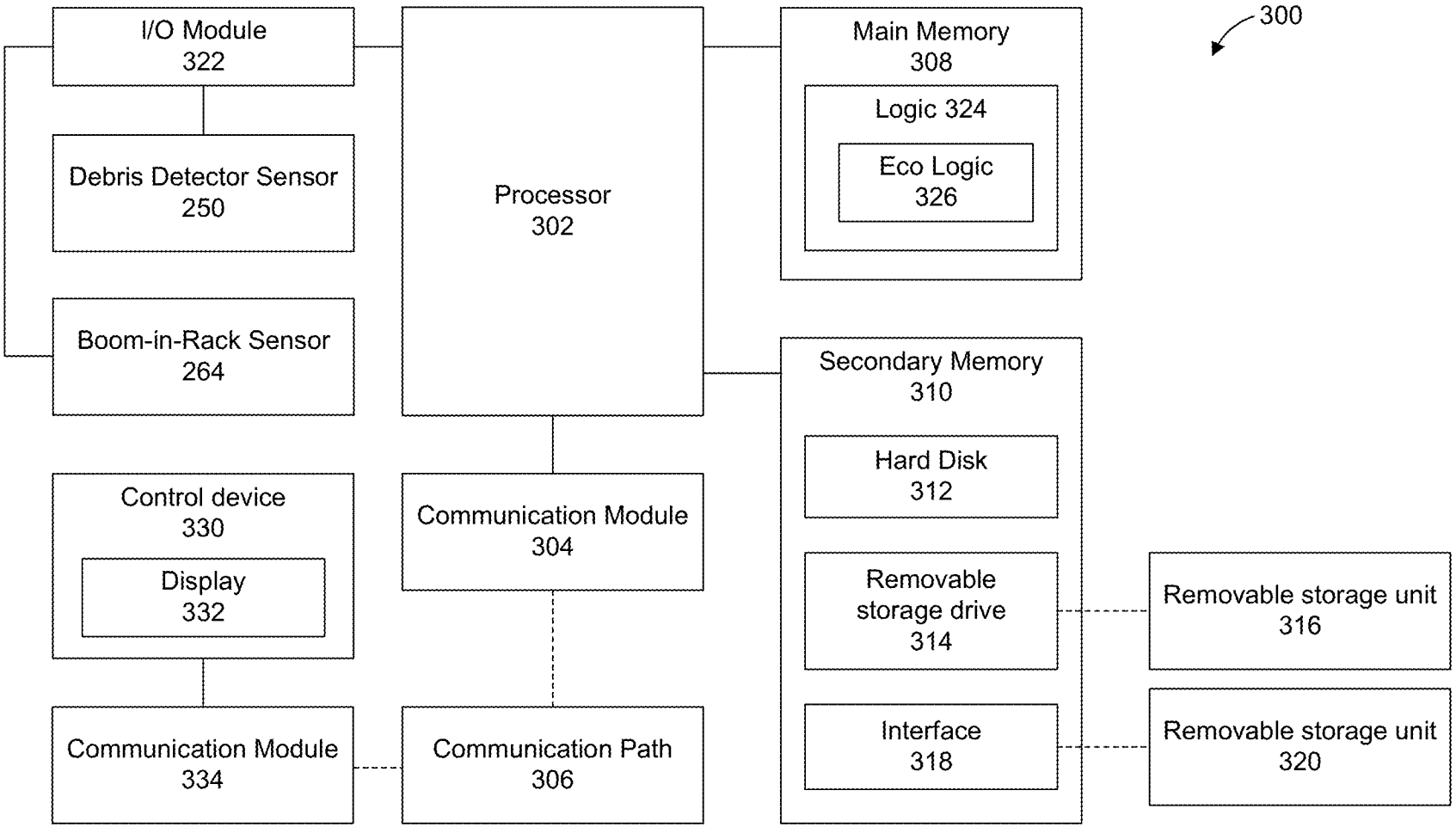
FIG. 13 a block diagram of an example control system according to various aspects of the invention.

In some aspects, boom-in-rack sensor 274 can output electronic data (e.g., proportional output voltage) that is received by processor 302 via I/O module 322 (FIG. 13). Processor 302 can use the electronic data received from boom-in-rack sensor 274 to determine whether boom 270 is positioned in boom rack 272.

In some aspects, the airflow developed by vacuum generator 232 can retrieve material from the pickup site. For example, material can enter the airflow from intake end 258 and travel through conduit 242, vacuum generator 232, and/or blades 234. In some aspects, material can be moved with the airflow through outlet 238 and into container 220. In some aspects, container can have an inlet 222 to facilitate intake of material. In some aspects, the material can exit the airflow and discharge into container 220. Container 220 can further include an outlet 224 for exhausting the airflow into the ambient environment. In other aspects, airflow can be recirculated to develop a regenerative vacuum in vacuum generator 232. In some aspects, material can be disposed of via container 220.

In some aspects, material collection system 10 components can include a debris detector sensor 260 that can indicate when material is present in conduit 252. In some aspects, debris detector sensor 260 is supported by sensor mount 262. In some aspects, sensor mount 262 can include a bracket that rotates about a point (e.g., swivels and/or tilts). In some aspects, sensor mount 262 can provide additional adjustability of the position of debris detector sensor 260, for example, vertical and/or horizontal adjustment. Additionally, in some aspects, sensor mount 276 can include a flexible arm that can support debris detector sensor 260 and be shaped into a support position. Sensor mount 262 can further include an enclosure to protect debris detector sensor 260. In some aspects, debris detector sensor 260 can be located on hose eye 250. In some aspects, debris detector sensor 260 is located on intake end 248. Debris detector sensor 260 can additionally be located on the interior wall 254 or exterior wall 256 of conduit 252. Positioning flexibility can increase the installation range and therefore sensing zone of debris detector sensor 260. For example, in a photoelectric sensor, an emitter and a receiver can be mounted on opposite sides of intake end 248.

In some aspects, debris detector sensor 260 can output electronic data that is received by processor 302 via I/O module 322 (FIG. 13). Processor 302 can use the electronic data received from debris detector sensor 260 to determine if material is present in conduit 252.

In some aspects, the one or more sensors, such as boom-in-rack sensor 274, can indicate the position of boom 270 in deployed position 50 (i.e., the swing position of boom 270). For example, boom-in-rack sensor 274 can indicate the position of boom 270 relative to vehicle 20, the ground, and/or material to be collected using for example, photoelectric, GPS, camera, and/or accelerometer data. In some aspects, in combination with other sensors, such as and/or debris detector sensor 260, this position can indicate if boom 270 is in a position where material would or would not likely be collected. In some aspects, the one or more sensors can indicate when boom 270 is moving from a first deployed position where material is not likely to be collected to a second deployed position 50 where material is likely to be collected. In an aspect, the engine speed can be increased once boom 270 reaches the second deployed position 50. In another aspect, the engine speed can be increased while boom 270 is moving toward the second deployed position 50.

Material collection system 10 can pick up and remove material from a pickup site of various compositions and/or sizes. For example, the material can be natural debris (e.g., leaves, branches, or dirt), recyclables (e.g., plastics, metals, or papers), and/or waste (e.g., food waste or non-recyclables). Debris, such as natural debris, can further include particulate matter (i.e., matter suspended in air). In some aspects, conduit 252 and container 220 can be configured to intake and contain a plurality of different types of materials, respectively. Intake end 248 can include a plurality of attachments that can enable intaking of a plurality of materials. For example, intake end 248 can include a cutting attachment (not shown) that can attach to its nozzle. This attachment can be configured to cut, for example, wet leaves and/or plastic waste so that the material can be collected by material collection system 10. Thus, while the cross-sectional area of conduit 252 and intake end 248 can be fixed in some aspects, the system is capable of intaking larger sized material and material of different shapes.

In other aspects, intake end 248 can include material for engagement with a plurality of materials. For example, material can include rigid materials such as rocks that can damage material collection system 10 and/or vehicle 20. Intake end 248 can contain metal (e.g., steel) such that intake end 248 retains its structure when engaging with certain materials. This aspect can be included for certain applications, such as excavation (i.e., breakage of material for collection and disposal). In some aspects, a broom attachment (not shown) configured to sweep a surface can attach to intake end 248 and/or another part of material collection system 10. The broom attachment can be used for collection of material for intake. In some aspects, airflow can be recirculated within the broom attachment to contain particulate matter.

In some aspects, particulate matter such as leaf dust can require additional processing for containment in container 220. Containment of particulate matter can prevent it from exhausting through outlet 224 and returning to the environment. Exhausting particulate matter can be undesirable as it can return material to the environment and can impair nearby operators (e.g., operators can breathe in particulates or hurt their eyesight). Leaf material, for example, can include dry leaves and/or wet leaves. Leaves, because of their weight, can be directed downward through container 220. However, dry leaves can include leaf dust which cannot be similarly directed downward. In some aspects, material collection system 10 can further include a water system (not shown), such as a water tank, a water pump, and/or a water line. In some aspects, container 220 can receive water. In some aspects, water can function to remove the particulate matter from the airflow such that it can be directed downward by the added weight. In some aspects, liquid from wet material can be discharged through outlet 224. In other aspects, liquid can be redirected through the water system for reuse. In other aspects, a second container (not shown) can be configured to collect particulate matter exhausted from outlet 224. The second container can be external to material collection system 10, such as in the trailer-mounted embodiment of FIG. 2. In this embodiment, container 220 can be, for example, located on the towing vehicle.

In some aspects, material collection system 10 components can include debris level sensor 284 to provide information related to the amount of material in container 220. In some aspects, debris level sensor 284 can indicate that container 220 is nearly filled or full. In an aspect, this condition can signal that vacuum generator 232 does not need to be powered at a high speed. In some aspects, vacuum generator 232 can run at a lower speed since material collection can be limited if container 220 cannot hold additional material.

Figure 8:
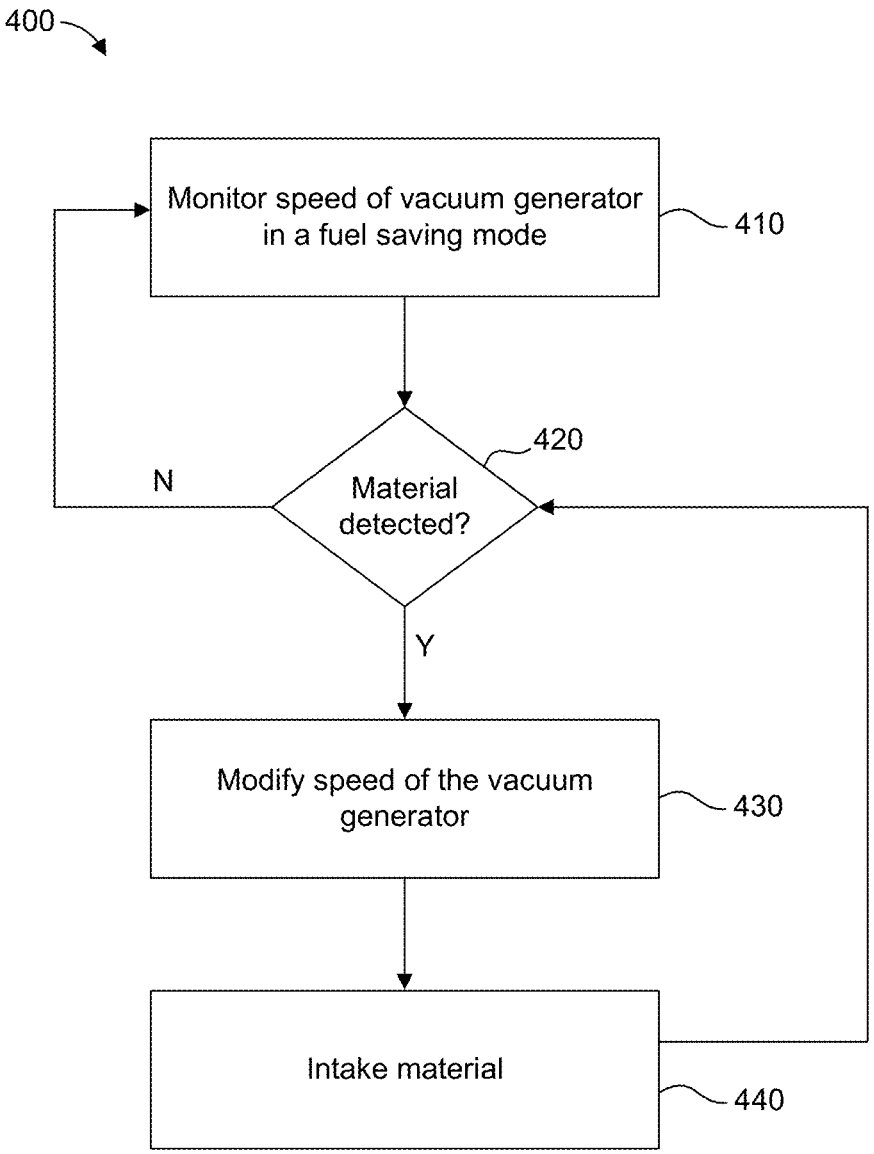
FIG. 8 is a flow chart of an example method for controlling material collection equipment in a fuel/energy saving mode according to various aspects of the invention.

FIG. 8 shows a flow chart of an example method 400 executed by a processor, for operating material collection system 10 using energy saving mode 326. While method 400 is described with reference to boom-in-rack sensor 202 and debris detector sensor 260, it is to be appreciated that any of the one or more sensors can be used to execute any of the following steps. Additionally, while method 400 is described with reference to vacuum generator 232, it is to be appreciated that other components of power source 202 can be used to execute any of the following steps.

In some aspects, method 400 can include a step 410 of monitoring the speed of vacuum generator 232 while energy saving mode 326 is active. In an aspect, the speed of vacuum generator 232 can be decreased (e.g., to approximately 1,200 RPM) when material is not detected. The lower speed setting can be useful for conserving fuel and power when material is not being collected. In some aspects, vacuum generator 232 can operate at a Standby Speed (i.e., the idle speed) when material is not detected. In some aspects, the Standby Speed can be approximately 1,200 RPM. In some aspects, the operator can specify the Standby Speed via an input, such as through control device 330. In some aspects, the Standby Speed can be pre-set based on the engine operating conditions. In some aspects, the predetermined Standby Speed is predetermined by programming instructions (e.g., relay logic), such as logic 324, stored in a memory of control system 300 (FIG. 13). In some aspects, step 410 can include sending a signal to increase the speed of vacuum generator 232 from a first speed to a second speed. The first speed can be approximately zero and the second speed can be approximately the Standby Speed.

In some aspects, method 400 can include a step 420 of detecting material to be collected. In some aspects, detecting material can include monitoring sensor data from debris detector sensor 260. Debris detector sensor 260 can monitor the presence of material and output related electronic data to processor 302 which can then determine whether material is present in conduit 252.

In some aspects, the electronic data output from a sensor debris detector sensor 260, can correspond to a stored electronic data once the amount of material detected reaches a predetermined threshold. For example, debris detector sensor 260 can be configured to determine the amount of material present at a pickup site (e.g., via camera and airflow data) and output related electronic data to processor 302. In some aspects, the predetermined threshold is predetermined by programming instructions, such as logic 324, stored in a memory of control system 300 (FIG. 13).

In some aspects, if material is detected, method 400 can include a step 430 of sending a signal to increase the speed of vacuum generator 232 from a first speed to a second speed. The first speed can be the Standby Speed such that increasing the speed from approximately the Standby Speed can indicate that the system is operating to intake material. In another aspect, the first speed setting can be approximately 800 RPM, which can be the lowest speed setting. In energy saving mode 326, the first speed can be approximately 1,200 RPM, which can be an efficient low speed setting. This speed can be an efficient first speed to minimize fuel/energy and power consumption and to prevent regeneration from a low energy load. In some aspects, the first speed can be minimal, such as approximately zero, such that vacuum generator 232 is not running (e.g., vacuum generator 232 is off). In an aspect, the operator can increase the speed up to approximately 2,400 RPM. The system can consume maximum fuel/energy and power at this speed setting. In an aspect, a higher speed setting can be useful for intaking material. A larger amount of material can be collected and/or material can be more quickly collected. Accordingly, the second speed can be higher than the first speed (e.g., approximately between 1,200 RPM and 2,400 RPM). In some aspects, while at a high speed (e.g., above 1,200 RPM), vacuum generator 232 can have sustained kinetic energy such that maintaining power to vacuum generator 232 is not needed. To increase fuel/energy efficiency, power takeoff(s) 216, for example, can be disengaged from vacuum generator 232 when a high speed is reached. Similarly, power takeoff(s) 216 can engage with vacuum generator 232 when its speed is reduced and/or when the inertia is reduced from drag or material conveyance.

In some aspects, step 430 can include determining if the amount of material detected reaches a predetermined threshold. If the amount of material detected is at least the predetermined threshold, a signal can be sent to increase the speed of vacuum generator 232 from the first speed to the second speed. In some aspects, the signal sent corresponds to the amount of material detected such that the electronic data output from debris detector sensor 260, is proportional to the amount of material present at a pickup site. In this way, the speed of vacuum generator 232 can be proportional to the amount of material detected and/or collected (i.e., the demand of the conveyance). Once the predetermined threshold is reached, a signal can be sent to adjust the speed of vacuum generator 232 in proportion to the amount of material present at the pickup site. The second speed as a function of the amount of material present can be an efficient method of intaking material. Fuel/energy and power consumption can be proportional to the material collection and energy waste can be minimized.

In some aspects, the stored electronic data and/or predetermined threshold can be specified to efficiently manage fuel/energy and power consumption. In some aspects, the stored electronic data and/or threshold can be specified via an input by the operator, such as, through control device 330. In an aspect, the speed of vacuum generator 232 can be adjusted as described above based on the specified inputs. In some aspects, the stored electronic data and/or predetermined threshold can be based on the type of material present at the pickup site. For example, the operator can select the type of material present at the pickup site (e.g., natural debris, plastic waste, etc.) via control device 330, and control system 300 can be configured to use corresponding stored electronic data and/or a predetermined threshold. The speed of vacuum generator 232 can then be adjusted from a first speed to a second speed according to the type of material to be collected. For example, if thicker or heavier material is present in conduit 252, the second speed can be a high speed such as approximately 2,400 RPM to intake the material. If lighter material is present in conduit 252, the second speed can be a speed between the Standby Speed and the maximum speed to intake the material without expending unnecessary fuel/energy and power.

In some aspects, the stored electronic data and/or predetermined threshold can be additionally determined based on environmental conditions such as weather and/or incline. The operator can select conditions via control device 330, and control system 300 can be configured to use corresponding stored electronic data and/or a predetermined threshold. For example, a lower threshold can be defined in colder conditions. The speed of vacuum generator 232 can accordingly be adjusted to a higher second speed more quickly when material is present in conduit 252 to operate a material collection operation. This can be useful to conserve fuel/energy and power while considering external factors relevant to material collection and vehicle operation.

In some aspects, the stored electronic data and/or predetermined threshold can be additionally determined based on GPS positioning data. GPS positioning can be used to indicate when a material collection operation has ended. For example, control system 300 can determine when material collection system 10 and/or vehicle 20 are at a pickup site such that a material collection operation can proceed. Using GPS positioning, control system 300 can determine when material collection system 10 and/or vehicle 20 are not at the pickup site. In some aspects, control system 300 can additionally detect a motive speed of vehicle 10 that can indicate when material collection system 10 and/or vehicle 20 are not at the pickup site. The speed of vacuum generator 232 can be reduced accordingly. Similarly, control system 300 can store in a memory this GPS positioning data related to pickup sites such that GPS positioning can be used to determine when a pickup site is being approached. The speed of vacuum generator 232 can be increased accordingly. In other aspects, control system 300 can retrieve operator-sourced data and/or crowd-sourced data (e.g., via customers, local officials, community representatives, etc.) to determine the pickup site. As the pickup site is approached, the speed of vacuum generator 232 can be increased. In some aspects, control system 300 can additionally detect a motive speed of vehicle 10 that can indicate when material is not being collected. For example, vehicle 10 can travel at approximately five miles per hour to pick up material. If the motive speed of vehicle 10 is above or below approximately this speed, the speed of vacuum generator 232 can be reduced.

In some aspects, GPS positioning can indicate the position of boom 270 at a pickup site, such as via boom-in-rack sensor 274. In an aspect, operator-sourced data can include deployed positions 50 of boom 270 that can signal an active material collection operation. In some aspects, boom 270 can include a removably attached wand (i.e., a manual adjustment mechanism), which can provide GPS positioning data. In an aspect, boom 270 can determine if an operator is within the vicinity of boom 270, conduit 252, and/or intake end 248, such as via GPS, camera, vibrational, sound, and/or capacitive data. In an aspect, the speed of vacuum generator 232 can be increased when boom 270 is in a particular deployed position 50, manually controlled (e.g., via the wand), and/or when an operator is nearby. In some aspects, the stored electronic data can be additionally determined based on voice operation by an operator. In an aspect, the speed of vacuum generator 232 can be adjusted by a voice operation where material collection system 10 can process vibrational and/or sound data.

In some aspects, the stored electronic data can be additionally determined based on the material load in and/or traveling through material collection system 10. In an aspect, if material is in and/or traveling through, for example, conduit 252, vacuum generator 232 (i.e., via a fan and/or blades 234), and/or container 220, the speed of vacuum generator 232 can be increased. If material is not being conveyed and/or the amount of material being conveyed is falling below a predetermined threshold, the speed of vacuum generator 232 can be decreased. Similarly, if the material load in container 220 is such that additional material cannot be stored, the speed of vacuum generator 232 can be decreased. In some aspects, one or more sensors can be mounted throughout material collection system 10 to monitor the material load. In some aspects, the material load can be determined based on debris level sensor 284, photoelectric, GPS, camera, accelerometer, load cell, and/or vibrational data. For example, vibrational data can indicate additional weight on boom 270 such that material is being conveyed. This can signal a need to increase the speed of vacuum generator 232. In other aspects, the load on power source 202, such as a fan vacuum generator 232 can be monitored.

In some aspects, the stored electronic data and/or predetermined threshold can be additionally determined based on vacuum generator 232. For example, if vacuum generator 232 contains a fan through which material travels and blades 234 that break down and/or compacts material as it passes through the fan, a higher speed can be desirable. In some aspects, operating vacuum generator 232 at approximately 2,400 RPM can more efficiently break down and/or compact material. In an aspect, the speed of vacuum generator 232 can be increased when material is being conveyed to efficiently break down and/or compact material. In some aspects, operating vacuum generator 232 at a lower speed can be less efficient. For example, fuel/energy and power consumption is less efficient when operating vacuum generator 232 at 1,200 RPM with no material conveyance than at 1,800 RPM with no material conveyance. Similarly, fuel/energy and power consumption is less efficient when operating vacuum generator 232 at 1,800 RPM with no material conveyance than at 2,400 RPM with no material conveyance. In an aspect, the speed of vacuum generator 232 can be decreased when material is not being conveyed to conserve fuel/energy and power consumption.

In some aspects, the stored electronic data can be additionally determined based on operational conditions such as pickup window of time and/or time of day. A lower threshold can be defined, for example, when the pickup window of time is short or the time of day is very early or late (i.e., before sunrise or nighttime), to minimize disturbance to the community. A higher threshold can be defined, for example, when the pickup window of time is longer and/or is during an active time of day. Here, the speed of vacuum generator 232 can be adjusted to a higher second speed to conserve fuel/energy and power consumption until a larger amount of material is present in conduit 252. In some aspects, a higher threshold for indicating the presence of material can be advantageous for reserving fuel/energy and power. The corresponding stored electronic data and/or predetermined threshold can be predetermined by programming instructions, such as logic 324, stored in a memory of control system 300.

In some aspects, once the signal is received, method 400 can include a step 440 of intaking material via airflow from vacuum generator 232. In some aspects, step 440 can include monitoring debris detector sensor 260 such that a signal is sent at predetermined time intervals to control the speed of vacuum generator 232. In some aspects, the predetermined time intervals can be predetermined by programming instructions, such as logic 324, stored in a memory of control system 300. In some aspects, debris detector sensor 260 can monitor the presence of material in step 420 and output related electronic data to processor 302 which can then determine whether the received electronic data corresponds to a stored electronic data. In some aspects, if the received electronic data does not correspond to the stored electronic data, a signal can be sent to return vacuum generator 232 to approximately the Standby Speed. In some aspects, method 400 can operate as described above at step 410.

Figure 9:
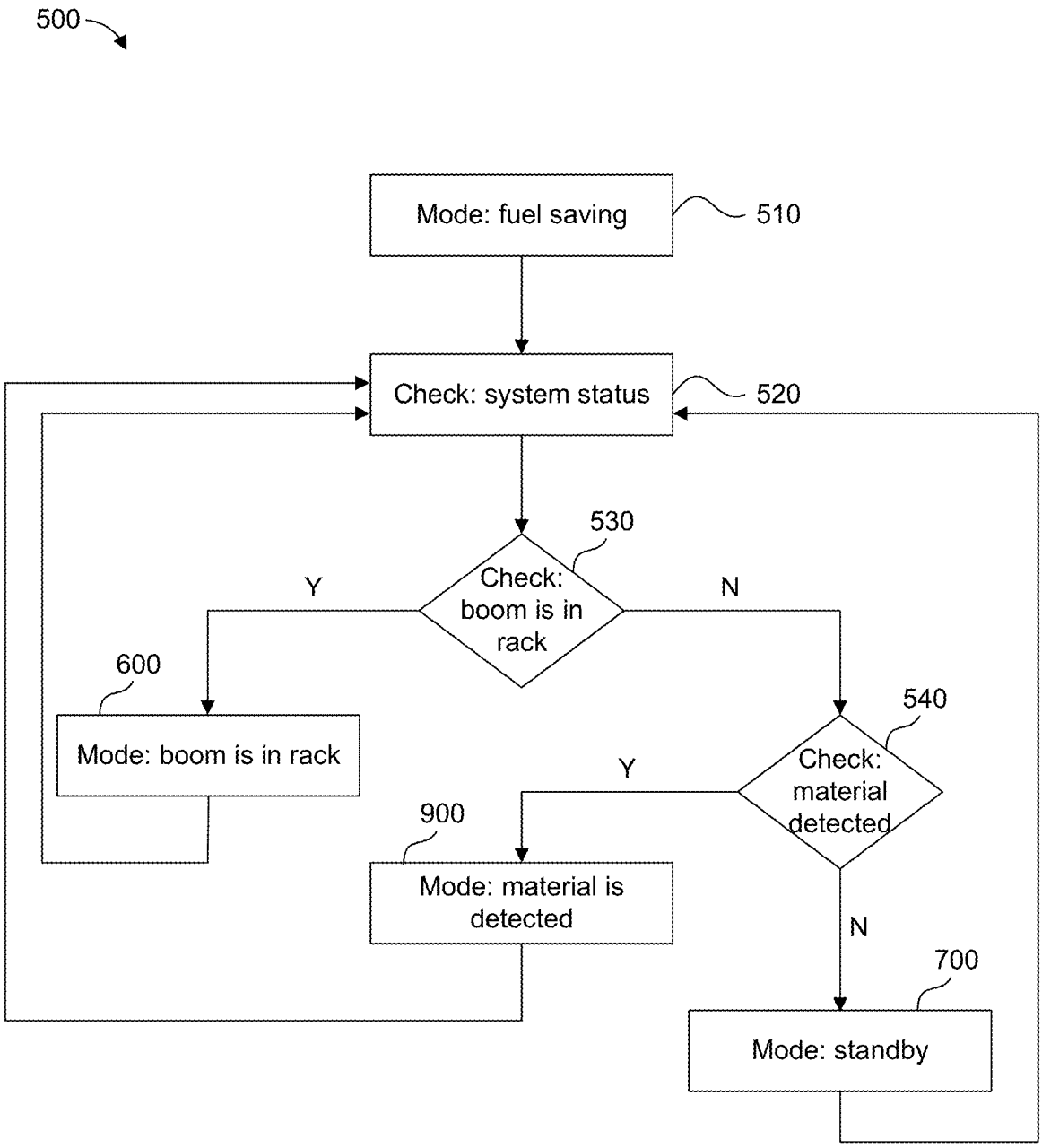
FIG. 9 is a flow chart of an example method for controlling material collection equipment in a fuel/energy saving mode according to various aspects of the invention.

FIG. 9 shows a flow chart of an example method 500 executed by a processor, for operating material collection system 10 using energy saving mode 326. While method 500 is described with reference to boom-in-rack sensor 202 and debris detector sensor 260, it is to be appreciated that any of the one or more sensors can be used to execute any of the following steps. Additionally, while method 400 is described with reference to vacuum generator 232, it is to be appreciated that other components of power source 202 can be used to execute any of the following steps.

In some aspects, method 500 can include a step 510 of determining that energy saving mode 326 is activated. In some aspects, vacuum generator 232 automatically runs at approximately the Standby Speed. In some aspects, the operator can input the Standby Speed, such as through control device 330. Additionally, in some aspects, the Standby Speed predetermined by, for example, programming instructions, such as logic 324 and/or logic for energy saving mode 326. In some aspects, method 500 can include a step 520 of checking the status of the system. Display 336 of control device 330 can include information on fault, alarm, and/or operational statuses of vehicle 20 and/or material collection system 10 components.

In some aspects, method 500 can include a step 530 of determining if boom-in-rack sensor 202 indicates that boom 270 is positioned in a rack 272. In some aspects, detecting if boom 270 is positioned in rack 272 can include monitoring sensor data from boom-in-rack sensor 202. Boom-in-rack sensor 202 can output related electronic data to processor 302, which can then determine if boom 270 is positioned in rack 272.

Figure 10:
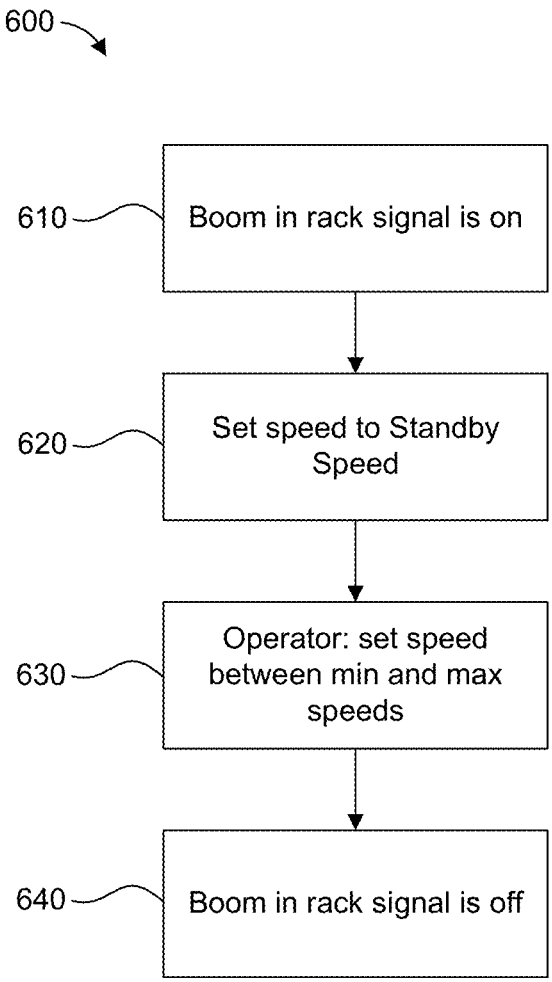
FIG. 10 is a flow chart of an example method for controlling material collection equipment in a fuel/energy saving mode according to various aspects of the invention.

In some aspects, if boom 270 is positioned in rack 272, method 500 can include a step 600 of operating a boom-in-rack mode. With reference to FIG. 10, method 600 (i.e., boom-in-rack mode) can include a step 610 of determining that boom 270 is positioned in rack 272. In some aspects, method 600 can include a step 620 of setting the speed of vacuum generator 232 to the Standby Speed. In some aspects, at step 620, a signal is sent to adjust the speed of vacuum generator 232 from a first speed to the Standby Speed.

In some aspects, at step 630, the operator can adjust the speed of vacuum generator 232 between a minimum speed and a maximum speed. In some aspects, the operator can input the minimum speed and/or maximum speed, such as through control device 330. Additionally, in some aspects, the minimum speed and/or maximum speed is predetermined by programming instructions, such as logic 324 and/or logic for energy saving mode 326. In some aspects, the operator can adjust the speed of vacuum generator 232 to a minimal speed, such as approximately zero, such that vacuum generator 232 is not running (e.g., vacuum generator 232 is off).

In some aspects, method 600 can include a step 640 of determining that boom-in-rack sensor 202 indicates that boom 270 is not rack 272. In some aspects, with reference to FIG. 9, method 500 can return to step 520 when boom-in-rack mode is no longer active. Method 500 can include a step 540 of determining that boom 270 is not in rack 272, and material is not detected.

Figure 11:
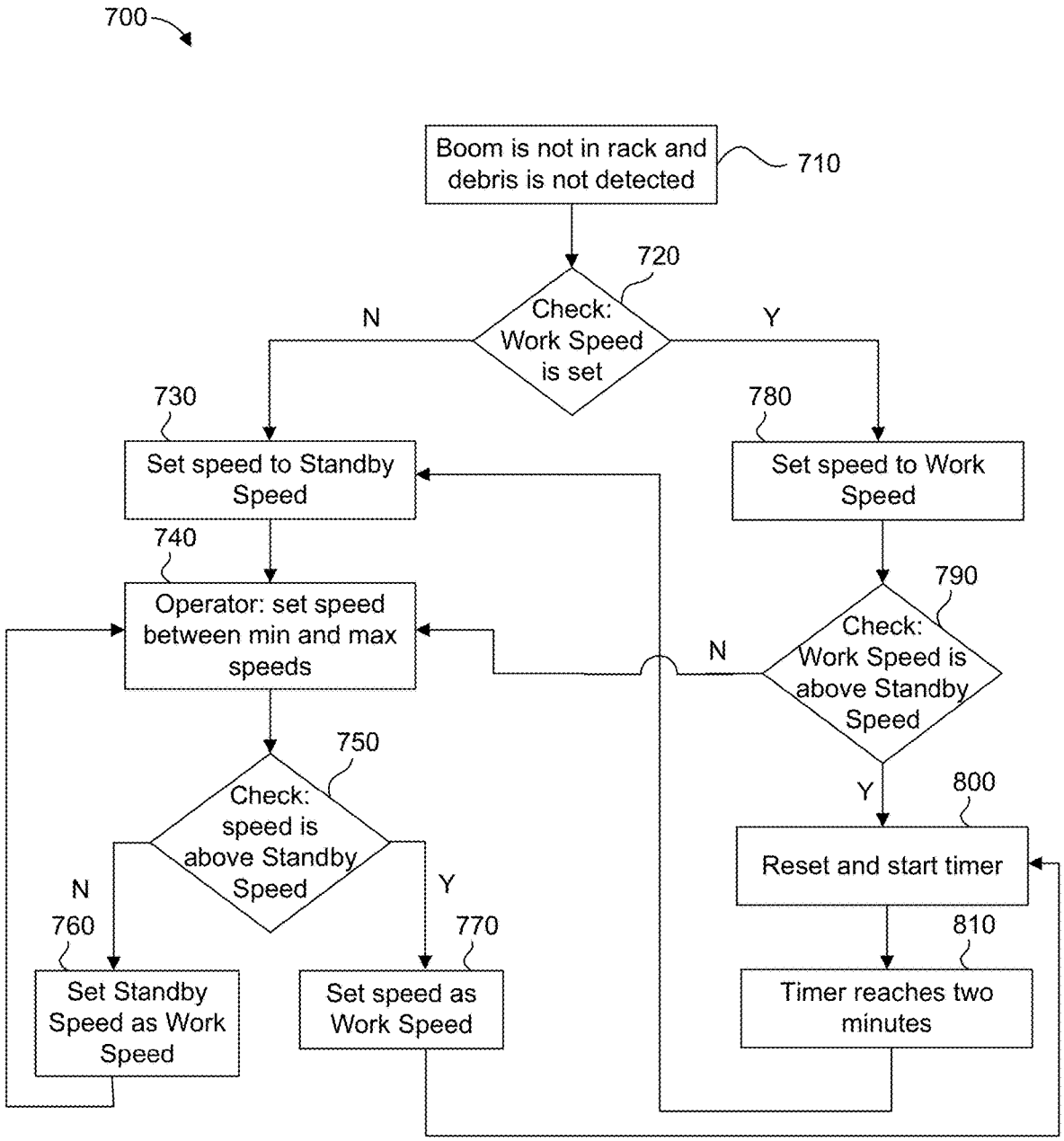
FIG. 11 is a flow chart of an example method for controlling material collection equipment in a fuel/energy saving mode according to various aspects of the invention.

In some aspects, method 500 can include a step 700 of operating a standby mode. With reference to FIG. 11, method 700 (i.e., standby mode) can include a step 710 of determining that vacuum generator 232 is in the standby mode. In some aspects, method 700 can include a step 720 of determining if a Work Speed is set. The Work Speed can be the speed of vacuum generator 232 during an operation (i.e., the operating speed), such as a material collection operation. In some aspects, the Work Speed can be approximately 2,400 RPM. In some aspects, where vacuum generator 232 drives vacuum generator 232, the Work Speed can correspond with the power output of vacuum generator 232. Accordingly, the Work Speed can correspond with the airflow developed by vacuum generator 232. Increasing the Work Speed can cause a proportional increase in the power output of vacuum generator 232 and the resulting airflow. In some aspects, the operator can input the Work Speed, such as through control device 330. Additionally, in some aspects, the Work Speed predetermined by programming instructions, such as logic 324 and/or logic for energy saving mode 326.

In some aspects, method 700 can include a step 730 of determining that the Work Speed is not set. In an aspect, step 730 can include setting the speed of vacuum generator 232 to approximately the Standby Speed. In some aspects, at step 730, a signal can be sent to adjust the speed of vacuum generator 232 from a first speed to approximately the Standby Speed.

In some aspects, method 700 can include a step 740 of adjusting the speed of vacuum generator 232 between the minimum speed and the maximum speed. In some aspects, the operator can adjust the speed of vacuum generator 232 to a minimal speed, such as approximately zero, such that vacuum generator 232 is not running (e.g., vacuum generator 232 is off). In some aspects, at step 760, a signal is sent to adjust the speed of vacuum generator 232 from approximately the Standby Speed to a second speed. In some aspects, method 700 can include a step 750 of determining if the speed of vacuum generator 232 is above approximately the Standby Speed.

In some aspects, step 740 can include setting the speed of vacuum generator 232 to a speed below the Standby Speed. In some aspects, method 700 can include a step 760 of setting the Standby Speed as the Work Speed. In some aspects, step 740 can include setting the speed of vacuum generator 232 to a speed above the Standby Speed. In some aspects, method 700 can include a step 770 of setting the second speed as the Work Speed.

In some aspects, method 700 can include a step 800 of resetting and starting a timer. In some aspects, the operator can input the timer run time, such as through control device 330. Additionally, in some aspects, the timer run time is predetermined by, for example, programming instructions, such as logic 324 and/or logic for energy saving mode 326. In some aspects, the timer can use GPS positioning to adapt the timer. For example, the timer run time can be adjusted down if boom 270 is not in a deployed position 50 such that material can be detected for collection. In some aspects, control system 300 can maintain historical data in a memory or via a separate historian that can be used to adjust the timer run time in this way. The historical data can include, for example, data related to deployed positions 50 of boom 270 that allows for material detection and/or collection, and the time required to complete a material collection operation. Control system 300 can also store in a memory operator inputted data that can be used along with historical data to modify the timer run time. In some aspects, logic 324 can include an on delay timer that can run once step 800 is active. Once the timer ends, the next program step can run. In some aspects, at step 800, the timer can run for two minutes, for example. The timer can run while the speed of vacuum generator 232 is the Work Speed.

In some aspects, the timer runs only while boom 270 is not positioned in rack 272. Accordingly, step 800 can include determining that boom-in-rack sensor 274 indicates that boom 270 is positioned in rack 272 before the timer ends. In an aspect, boom-in-rack mode can take priority over the timeout. For example, the next program step can run either when the timer ends or when boom-in-rack sensor 274 indicates that boom-in-rack mode is active. In an aspect, once boom-in-rack sensor 274 indicates that boom 270 is positioned in rack 272, an off delay timer can run. In an aspect, another mode (e.g., material is detected mode described below) can take priority over the timeout such that method 500 can activate another mode. In another aspect, once the off delay timer ends, boom in rack mode is active. In some aspects, with reference to FIG. 9, method 500 can return to step 520 when standby mode is no longer active.

In some aspects, method 700 can include a step 810 of setting the speed of vacuum generator 232 to the Standby Speed in step 730 once the timer ends. In some aspects, at step 730, a signal can be sent to adjust the speed of vacuum generator 232 from approximately the Work Speed to the Standby Speed.

In some aspects, method 700 can include a step 780 of setting the speed of vacuum generator 232 to the Work Speed. In some aspects, step 780 can additionally follow step 720 if the Work Speed is set such that the speed of vacuum generator 232 is set to the Work Speed instead of the Standby Speed. In some aspects, at step 730, a signal is sent to adjust the speed of vacuum generator 232 from a first speed to the Work Speed.

In some aspects, method 700 can include a step 790 of determining that the Work Speed is higher than the Standby Speed. In some aspects, method 700 can operate as described above at step 800.

In some aspects, method 700 can include a step 790 of determining that the Work Speed is not higher than the Standby Speed. In some aspects, method 700 can operate as described above at step 740.

In some aspects, with reference to FIG. 9, method 500 can return to step 520 when standby mode is no longer active. Method 500 can include a step 540 of determining that boom 270 is not in rack 272, and material is detected.

Figure 12:
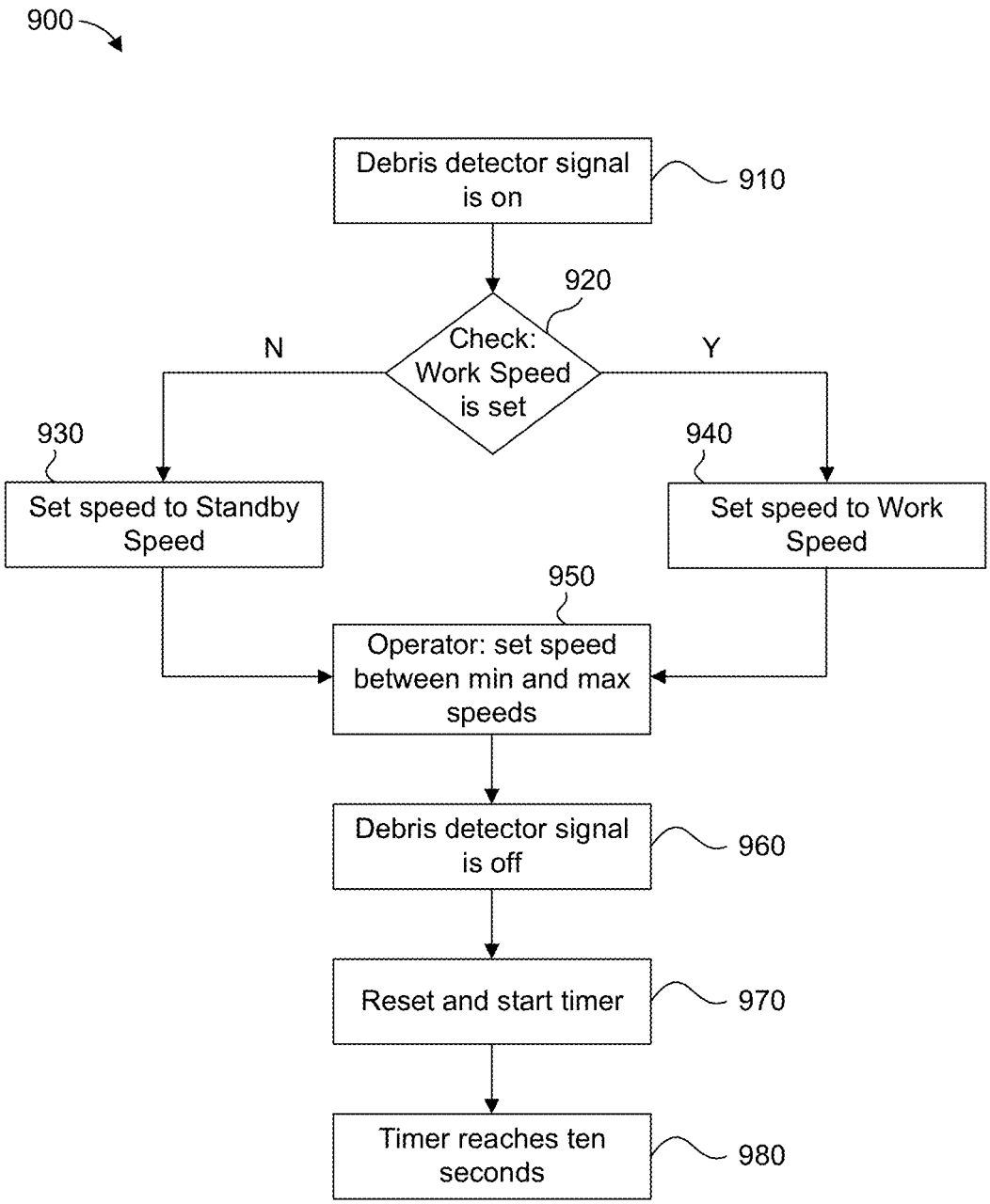
FIG. 12 is a flow chart of an example method for controlling material collection equipment in a fuel/energy saving mode according to various aspects of the invention.

In some aspects, method 500 can include a step 900 of operating a material is detected mode. With reference to FIG. 12, method 900 (i.e., standby mode) can include a step 910 of determining that vacuum generator 232 is in the material is detected mode.

In some aspects, step 910 can include determining that debris detector sensor 260 indicates that material is detected. In some aspects, detecting material can include monitoring sensor data from debris detector sensor 260. Debris detector sensor 260 can monitor the presence of material and output related electronic data to processor 302 which can then determine whether material is present in conduit 252.

In some aspects, method 900 can include a step 920 of determining if a Work Speed is set. In some aspects method 900 can include a step 930 of setting the speed of vacuum generator 232 to the Standby Speed if a Work Speed is not set. In some aspects, at step 930, a signal is sent to adjust the speed of vacuum generator 232 from a first speed to approximately the Standby Speed. In some aspects, method 900 can include a step 940 of setting the speed of vacuum generator 232 to approximately the Work Speed if a Work Speed is set such that the speed of vacuum generator 232 is set to the Work Speed instead of the Standby Speed. In some aspects, at step 940, a signal is sent to adjust the speed of vacuum generator 232 from a first speed to approximately the Work Speed.

In some aspects, method 900 can include a step 950 of adjusting the speed of vacuum generator 232 between the minimum speed and the maximum speed. In some aspects, the operator can adjust the speed of vacuum generator 232 to a minimal speed, such as approximately zero, such that vacuum generator 232 is not running (e.g., vacuum generator 232 is off). In some aspects, step 950 can follow step 930 or step 940.

In some aspects, method 900 can include a step 960 of determining that debris detector sensor 260 indicates that material is not detected. In some aspects, method 900 can include a step 970 of resetting and starting a timer. In some aspects, the operator can input the timer run time, such as through control device 330. Additionally, in some aspects, the timer run time can be predetermined by programming instructions, such as logic 324 and/or logic for energy saving mode 326. In some aspects, the timer can use GPS positioning to adapt the timer. For example, the timer run time can be adjusted down if boom 270 is not in a deployed position 50 such that material can be detected for collection. In some aspects, control system 300 can maintain historical data in a memory or via a separate historian that can be used to adjust the timer run time in this way. The historical data can include, for example, data related to deployed positions 50 of boom 270 that allow for material detection and/or collection, and the time required to complete a material collection operation. Control system 300 can also store in a memory operator inputted data that can be used along with historical data to modify the timer run time.

In some aspects, at step 970, the timer can run for ten seconds, for example. In some aspects, the timer runs only while material is not detected. The timer can be an off delay timer such that debris detector sensor 26 signal can turn off once the timer ends. Step 970 can include determining that debris detector sensor 260 indicates that material is detected in step 910 before the timer ends. In some aspects, with reference to FIG. 9, method 500 can return to step 520 when the timer ends and material is detected mode is no longer active.

With reference to FIG. 13, in some aspects, a control system 300 can be implemented as computer-readable code. For example, processing of operator inputs and field inputs, or control of material collection system 10 components can be implemented in control system 300 using hardware, software, firmware, tangible non-transitory computer readable media having instructions, data structures, program modules, or other data stored thereon, or a combination thereof, and can be implemented in one or more computer systems or other processing systems. Material collection system 10 can include all or some of the components of control system 300 for implementing processes discussed herein.

In some aspects, computer programs (also called computer control logic) such as logic 324 are stored in main memory 308 and/or secondary memory 310. Computer programs can also be received via communication module 304. Such computer programs, when executed, enable control system 300 to implement the aspects as discussed herein. In particular, the computer programs, when executed, enable processor 302 to implement the processes of the aspects discussed here. Accordingly, such computer programs represent controllers of the control system 300. Where the aspects are implemented using software, the software can be stored in a computer program product and loaded into control system 300 using removable storage drive 314, interface 318, and hard disk drive 312, communication module 304, and/or a cloud-based system via radio wireless systems.

Aspects of the invention(s) also can be directed to computer program products comprising software stored on any computer useable medium. Such software, when executed in one or more data processing device, causes a data processing device(s) to operate as described herein. Aspects of the invention(s) can employ any computer useable or readable medium. Examples of computer useable mediums include, but are not limited to, primary storage devices (e.g., any type of random access memory), secondary storage devices (e.g., hard drives, floppy disks, CD ROMS, ZIP disks, tapes, magnetic storage devices, and optical storage devices, MEMS, nanotechnological storage device, etc.).

In some aspects, if programmable logic is used, such logic can be executed on a commercially available processing platform or a special purpose device. One of ordinary skill in the art can appreciate that aspects of the disclosed subject matter can be practiced with various computer system configurations, including multi-core multiprocessor systems, minicomputers, and mainframe computers, computer linked or clustered with distributed functions, as well as pervasive or miniature computers that can be embedded into virtually any device.

For instance, at least one processor device and a memory can be used to implement the above described aspects. A processor device can be a single processor, a plurality of processors, or combinations thereof. Processor devices can have one or more processor "cores."

Various aspects of the invention(s) can be implemented in terms of example control system 300. After reading this description, it will become apparent to a person skilled in the relevant art how to implement one or more of the invention (s) using other computer systems and/or computer architectures. Although operations can be described as a sequential process, some of the operations can in fact be performed in parallel, concurrently, and/or in a distributed environment, and with program code stored locally or remotely for access by single or multi-processor machines. In addition, in some aspects the order of operations can be rearranged without departing from the spirit of the disclosed subject matter.

In some aspects, logic 324 can be downloaded to processor 302 and stored in main memory 308 and/or secondary memory 310. Logic 324 can include control logic related to various operational modes and/or various operations of material collection system 10. The operations can be defined using control modules and/or sequences that can run alone, in parallel, or in a phase (i.e., a grouping of sequences). In some aspects, logic 324 can include logic for operational modes including energy saving mode 326. In some aspects, logic 324 including logic for energy saving mode 326, is modifiable online and/or offline with access credentials (i.e., developer rights to software).

In some aspects, a processor 302 can be a special purpose or a general purpose processor device. As will be appreciated by persons skilled in the relevant art, processor 302 can also be a single processor in a multi-core/multiprocessor system, such system operating alone, or in a cluster of computing devices operating in a cluster or server farm. Processor 302 can be connected to a communication module 304, for example, a bus, message queue, network, or multi-core message-passing scheme.

In some aspects, control system 300 can include main memory 308, for example, volatile memory, such as random access memory (RAM), or nonvolatile memory, such as read-only memory (ROM). In some aspects, control system 300 can further include a secondary memory 310. Secondary memory 310 can include, for example, a hard disk drive 312, or a removable storage drive 314. Removable storage drive 314 can include a floppy disk drive, a magnetic tape drive, an optical disk drive, a flash memory, or the like. The removable storage drive 314 reads from and/or writes to a removable storage unit 316 in a well-known manner. Removable storage unit 316 can include a floppy disk, magnetic tape, optical disk, a universal serial bus (USB) drive, etc. which is read by and written to by removable storage drive 314. As will be appreciated by persons skilled in the relevant art, removable storage unit 316 can include a computer usable storage medium having stored therein computer software and/or data.

In other aspects, secondary memory 310 can include other similar means for allowing computer programs or other instructions to be loaded into control system 300. Such means can include, for example, removable storage unit 316 and an interface 318. Examples of such means can include a program cartridge and cartridge interface (such as that found in video game devices), a removable memory chip (such as an EPROM, or PROM) and associated socket, and other removable storage units 320 and interfaces 318 which allow software and data to be transferred from the removable storage unit 320 to control system 300.

In some aspects, control system 300 can also include a communication module 304. Communication module 304 can allow software and data to be transferred between control system 300 and external devices. Communication module 304 can include a modem, a network interface (such as an Ethernet card), a communication port, a PCMCIA slot and card, or the like. Software and data transferred via communication module 304 can be in the form of signals, which can be electronic, electromagnetic, optical, or other signals capable of being received by communication module 304. These signals can be provided to communication module 304 via a communication path 306. Communication path 306 can carry signals and can be implemented using wire or cable, fiber optics, a phone line, a cellular phone link, an RF link or other communication channels.

In this document, the terms "computer program medium" and "computer usable medium" are used to generally refer to media such as removable storage unit 316, removable storage unit 320, and a hard disk installed in hard disk drive 312. Computer program medium and computer usable medium can also refer to memories, such as main memory 308 and secondary memory 310, which can be memory semiconductors (e.g., DRAMs, etc.).

Figure 14:
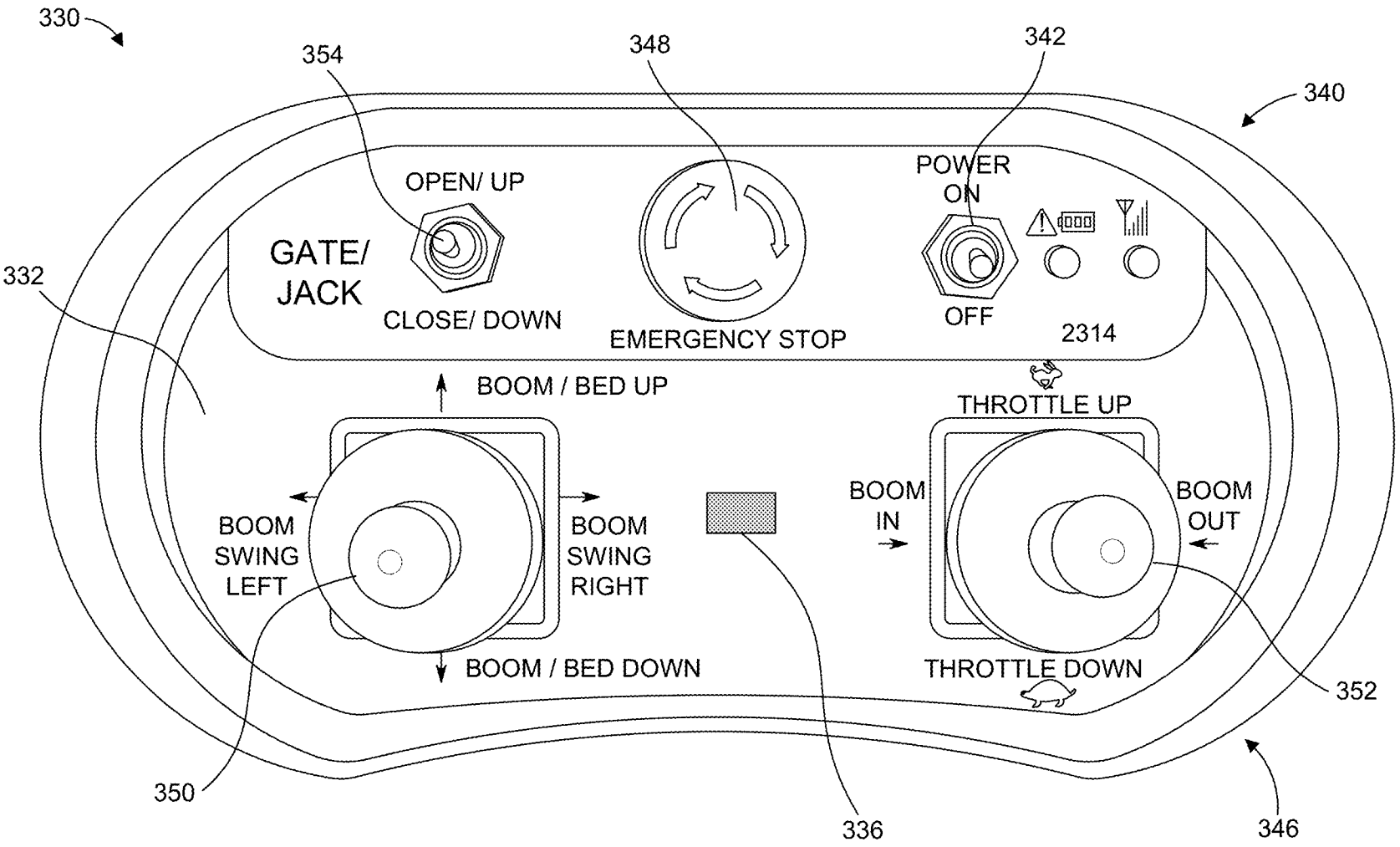
FIG. 14 is a top view of a control device according to various aspects of the invention.
Figure 15A:
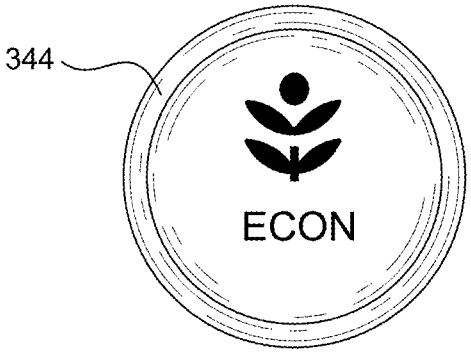
FIGS. 15A-D show perspective views of energy saving mode switches according to various aspects of the invention.
Figure 15B:
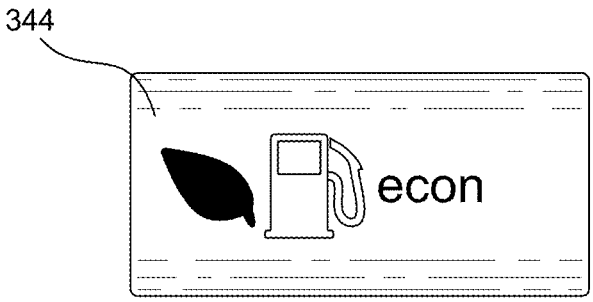
Figure 15C:
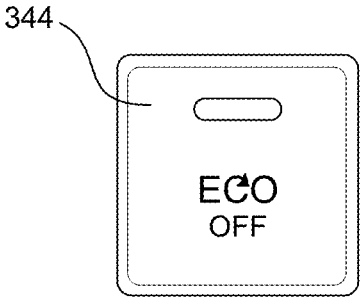
Figure 15D:
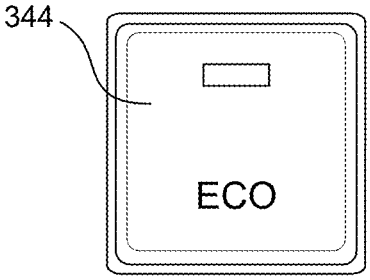

With reference to FIG. 14, in some aspects, control device 330 can include a display 332 that can provide operator control via displayed control(s) 340. In some aspects, when integrated into a control panel in cab 104 for example, display 332 can accept input devices such as a keyboard or a mouse to manipulate control(s) 340. In some aspects, control(s) 340 can also accept tactile inputs. In some aspects, the wireless and remote capabilities of the disclosed invention(s) allow control device 330 to additionally be a smart device (e.g., a smartphone, smartwatch, or tablet). A plurality of GUIs (graphical user interfaces) on display 332 can provide control(s) 340. In some aspects, display 332 can additionally include a GUI for emergency stop 348. In some aspects, control device 330 can further include display 336 that forwards data from communication module 304 (or from a frame buffer not shown) via communication module 334. Display 336 can provide the forwarded data which can include, for example, fault, alarm, and/or operational statuses (e.g., automatic or manual), and/or location information of vehicle 20 and/or material collection system 10 components. In some aspects, control system 300 can include a second control device 330 that includes a second display 336. The second control device 330 and/or display 336 can be limited to a component of material collection system 10 and/or vehicle 20, such as power source 202.

In some aspects, control system 300 can include a control device 330 that is a control panel located in cab 104. In some aspects, control device 330 can alternatively be a joystick integrated into cab 104 or a handheld device as shown in FIG. 9. In some aspects, control system 300 can include multiple control devices 330. Control device 330 can include a communication module 334 that functions similarly to communication module 304. The operator can use control(s) 340 on control device 330 to provide instructions for control system 300. Control(s) 340 can, for example, provide power control 342 (i.e., system on or system off), boom control 350, throttle control 352, and/or gate control 354. These instructions are communicated to communication module 304 as inputs to the computer program stored in main memory 308 and/or secondary memory 310. In some aspects, control(s) 340 can be integrated into, for example, buttons, knobs, joysticks, tabs, keypads, or a combination thereof. In some aspects, control system 300 additionally can include an emergency stop 348 that functions to stop a running system. Emergency stop 348 can be integrated into control device 330, similar to control(s) 340.

In some aspects, control system 300 can include an enabling switch 346 (i.e., a dead man switch or a live-man switch). Enabling switch 346 can be configured to increase the speed of vacuum generator 232 when in an actuated position. For example, the operator can push and hold enabling switch 346 to place it in the actuated position. When releasing the switch, enabling switch 346 can return to its non-actuated position. In the non-actuated position, the system can turn off, or in some embodiments, can be in its fail-safe position or mode (e.g., off or a predetermined on configuration). Enabling switch 346 can be integrated into control device 330, similar to control(s) 340. In some aspects, enabling switch 346 can be integrated into a pedal or an operator seat located within cab 104.

With reference to FIG. 15A-D, in some aspects, energy saving mode 326 can be activated by an operator action on an input 344 (e.g., a rocker switch). In some aspects, the input can be located within cab 104, on or near power source 202, and/or on or near a material collection system 10 component. In some aspects, control device 330 can include a control to activate energy saving mode 326 on display 332. In some aspects, input 344 cannot be included to prevent any type of override. In some aspects, control device 330 can include a control (e.g., a momentary switch) to manually adjust the speed of vacuum generator 232 on some or all of material collection 10 and/or vehicle 20 components.

In some aspects, a control on control device 330 can be in addition to input 344. Energy saving mode 326 can be activated while the system is on. When the system is powered on, energy saving mode 326 can be activated as well such that an operator action on input 344 deactivates the same. Alternatively, energy saving mode 326 can be activated by an operator action on input 344 after the system is powered on, which is to say that energy saving mode 326 is not initially activated. In some aspects, energy saving mode 326 can be deactivated in the same way that it is activated. In some aspects, deactivation of energy saving mode 326 does not interfere with normal operation of material collection system 10. Accordingly, the system can continue to operate without interference. In some aspects, enabling switch 346 can activate energy saving mode 326 when in its actuated position. In the non-actuated position, the system can be off, or in some aspects, can be in its fail-safe position or mode (e.g., off or a predetermined on configuration).

Figure 16:
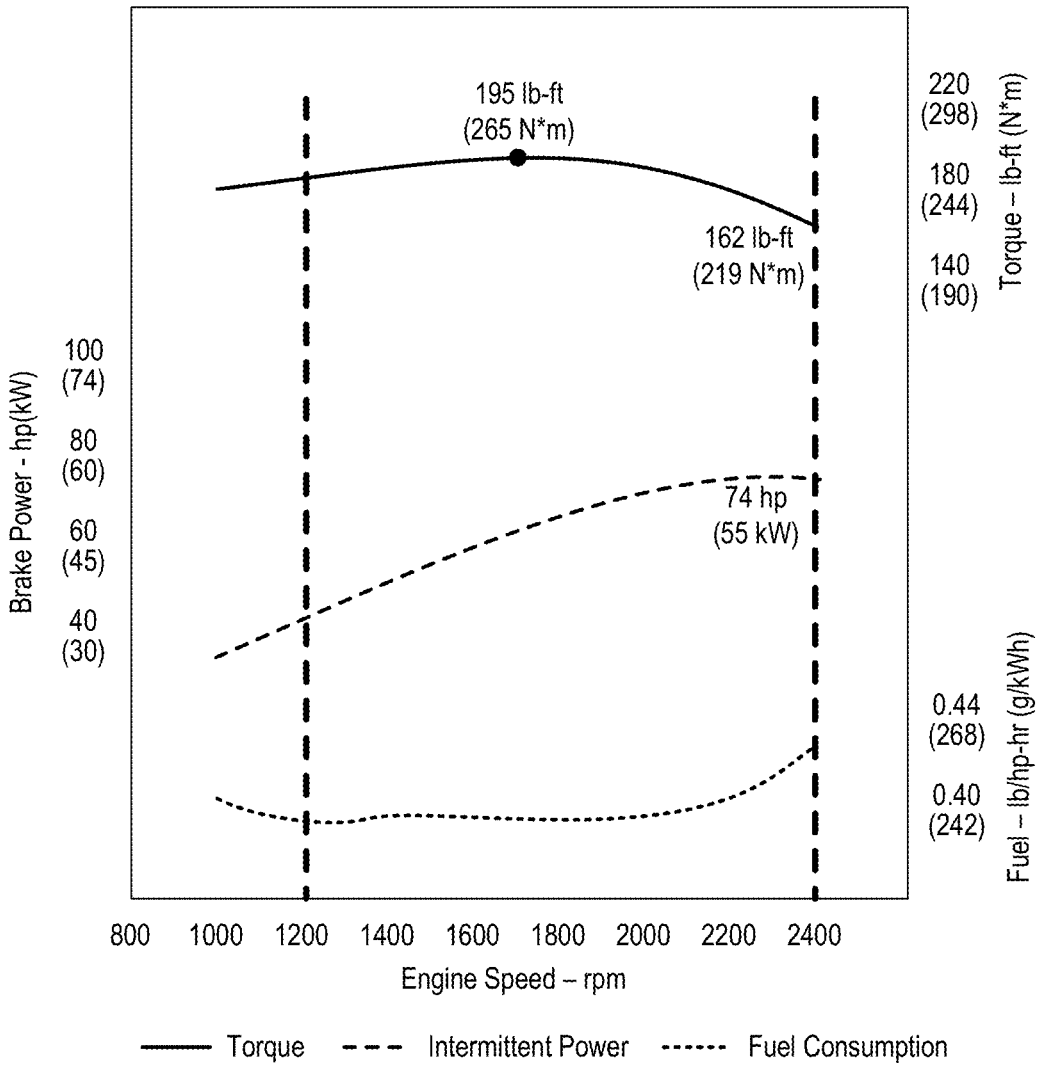
FIG. 16 is a graph of example engine operation curves according to various aspects of the invention.

With reference to FIG. 16, in some aspects, a fuel/energy saving mode, such as energy saving mode 326, an engine can operate at an efficient speed to conserve fuel/energy and power. For example, a 74 horse power engine can reduce its speed from approximately 2,400 RPM to 1,200 RPM when a boom of the device is stowed. In an aspect, at approximately 1,200 RPM, the engine can operate with high fuel/energy efficiency such that engine park regens are eliminated. This mode can increase fuel/energy economy by up to 11%, and can reduce cost of ownership by maintaining elevated exhaust temperatures (soot build up can be reduced). In other aspects, this engine and fuel/energy saving application can further be combined with a six blade impeller to provide improved material collection. Efficiency can differ based on the type and/or capacity of power source 202 for vacuum generator 232.

In some aspects, the disclosed inventions can require no additional investment in components; a simple program change can be implemented. If any component fails, the device can return to a regular mode automatically. In some aspects, the disclosed inventions can be retrofitted with existing systems.

In some aspects, with reference to FIG. 16 and the following chart, operating a speed in the fuel/energy saving mode rather than full power can increase efficiency by 206%. In an aspect, the increased efficiency can include reducing particulate matter production (e.g., dust) by 50%, noise by 50%, fuel/energy consumption by three gallons per hour or a comparable decrease in electrical power consumption, and operating costs by $3,000 per leaf season. In some aspects, the fuel/energy saving mode can reduce particulate matter production as the airflow is periodically reduced, decreasing the air that enters container 220 and its exhaust. Running a power source at a lower speed including for prolonged periods can also reduce wear and tear on components. For example, running an engine at a lower speed can lower engine revolutions, reducing wear and tear on engine moving components. This can reduce the need for servicing and produce additional cost savings.

| | Units | Fuel Saving | Full Power |
|---|---|---|---|
| Engine RPM | RPM | 1200 | 2400 |
| Fuel Consumption | lb/(hp-hr) | 0.39 | 0.43 |
| Power Consumption | HP | 26.6 | 74 |
| Pounds of Fuel per Hour | lb/hr | 10.4 | 31.8 |
| Gallons of Fuel per Hour | gal/hr | 1.5 | 4.5 |

It is to be appreciated that this fuel/energy saving application can be implemented in additional industries, such as sweepers for handling debris collection. Brush and broom parts can be integrated with the fuel/energy saving application to improve sweeping. Material handling fans (e.g., for conveying food, paper dust, or other materials), and railroad and metro vactrains can also utilize this fuel/energy saving application.

It is to be appreciated that the Detailed Description section, and not the Summary and Abstract sections, is intended to be used to interpret the claims. The Summary and Abstract sections can set forth one or more but not all exemplary embodiments of the present embodiments as contemplated by the inventor(s), and thus, are not intended to limit the present embodiments and the appended claims in any way.

The present disclosure has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the embodiments that others can, by applying knowledge within the skill of the art, readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present disclosure should not be limited by any of the above-described exemplary embodiments, but should be defined only in accordance with the following claims and their equivalents.

What is claimed is:

1. A material collection system, comprising:
- a conduit including a material inlet;
- a vacuum generator to develop an airflow and draw material into the material inlet;
- a boom moveable from a stowed position to an operating position to support the conduit;
- a first sensor to indicate a presence, absence, or amount of material in the conduit and provide a first sensor output signal;
- a second sensor to indicate whether the boom is in the stowed position or the operating position and provide a second sensor output signal; and
- a control system to control a speed of the vacuum generator to a first speed and a second speed based on the first sensor output signal and the second sensor output signal.

2. The material collection system of claim 1, wherein the first speed is an idle speed and the second speed is a work speed that is greater than the idle speed.

3. The material collection system of claim 1, wherein the first speed is approximately 1,200 RPM.

4. The material collection system of claim 1, wherein the second speed is approximately 2,400 RPM.

5. The material collection system of claim 1, wherein the first speed is zero and the second speed is greater than approximately 1,200 RPM.

6. The material collection system of claim 1, wherein the first sensor is positioned at the material inlet.

7. The material collection system of claim 1, wherein the first sensor is positioned adjacent to the vacuum generator.

8. The material collection system of claim 1, wherein the vacuum generator is powered by an internal combustion engine such that the control system controls the speed of the internal combustion engine to control the speed of the vacuum generator.

9. A material collection system, comprising:
- a vacuum generator;
- a conduit including a material inlet;
- a boom to support the conduit, the boom being movable from a stowed position to an operating position;
- a material collection container to receive collected material from the conduit;
- a sensor to indicate whether the boom is in the stowed position or the operating position and provide a sensor output signal; and
- a control system to control a speed of the vacuum generator to a first speed setting and a second speed setting based on the sensor output signal.

10. The material collection system of claim 9, further comprising:
- a second sensor to indicate a presence, absence, or amount of material in the conduit, the second sensor providing a second sensor output signal,
- wherein the control system controls the speed of the vacuum generator based on the second sensor output signal.

11. The material collection system of claim 9, further comprising:
- a second sensor to indicate a full condition of the material collection container, the second sensor providing a second sensor output signal,
- wherein the control system controls the speed of the vacuum generator based on the second sensor output signal.

12. The material collection system of claim 11, wherein the second speed is approximately 1,200 RPM when the second sensor indicates the full condition.

13. A method for operating a material collection system, comprising:
- operating a vacuum generator at a first speed, the vacuum generator developing an airflow to draw material into a material inlet of a conduit supported by a boom that is moveable from a stowed position to an operating position;
- receiving an electronic signal indicating movement of the boom from the stowed position to the operating position; and
- based on the electronic signal, increasing the speed of the vacuum generator to a second speed.

14. The method of claim 13, wherein the first speed is less than approximately 2,400 RPM.

15. The method of claim 13, wherein the second speed is greater than approximately 1,200 RPM.

16. The method of claim 13, further comprising receiving a second electronic signal indicating a presence, absence, or amount of material in the conduit; and
- increasing the speed of the vacuum generator to the second speed further based on the second electronic signal.

17. The method of claim 13, further comprising receiving a user input to change the second speed.

18. The method of claim 13, wherein the speed of the vacuum generator is increased to the second speed while moving the boom from the stowed position to the operating position.

19. The method of claim 13, wherein increasing the speed of the vacuum generator to the second speed comprises controlling the speed of an engine of a material collection vehicle.

20. The method of claim 13, further comprising receiving a second electronic signal indicating a full condition of the material collection container; and decreasing the speed of the vacuum generator from the second speed based on the second electronic signal.

* * * * *